US006343964B1

(12) United States Patent
Mardikian

(10) Patent No.: US 6,343,964 B1
(45) **Date of Patent: *Feb. 5, 2002**

(54) JET BOAT WITH IMPROVED HULL DESIGN AND ENGINE PLACEMENT

(76) Inventor: Albert Mardikian, 45 Goleta Point Dr., Corona Del Mar, CA (US) 92625

( * ) Notice: Subject to any disclaimer, the term of this patent is extended or adjusted under 35 U.S.C. 154(b) by 0 days.

This patent is subject to a terminal disclaimer.

(21) Appl. No.: 09/712,686

(22) Filed: Nov. 14, 2000

Related U.S. Application Data

(63) Continuation of application No. 09/137,899, filed on Aug. 20, 1998, now Pat. No. 6,168,481.

(51) Int. Cl.[7] ..... B63H 11/00

(52) U.S. Cl. ..... 440/39; 114/151; 440/38; 440/46

(58) Field of Search ..... 440/38, 39, 46; 114/55.5, 61.32, 62, 151

(56) References Cited

U.S. PATENT DOCUMENTS

| | | | | | |
|---|---|---|---|---|---|
| 3,139,060 | A | * | 6/1964 | Dane | 440/39 |
| 3,339,516 | A | | 9/1967 | Lenci | 440/39 |
| 3,384,047 | A | * | 5/1968 | Remley | 440/39 |
| 3,933,113 | A | | 1/1976 | Dornak, Jr. | 114/151 |
| 4,004,542 | A | | 1/1977 | Holmes | 114/56 |
| 5,056,450 | A | | 10/1991 | Mardikian | 114/144 R |
| 5,092,260 | A | | 3/1992 | Mardikian | 114/285 |
| 5,193,478 | A | | 3/1993 | Mardikian | 114/286 |
| 5,203,728 | A | | 4/1993 | Kobayashi | 440/38 |
| 5,224,887 | A | | 7/1993 | Futaki | 440/46 |
| 5,299,960 | A | | 4/1994 | Day et al. | 440/39 |
| 5,309,861 | A | | 5/1994 | Mardikian | 114/363 |
| 5,366,397 | A | | 11/1994 | Suganuma et al. | 440/39 |
| 5,367,978 | A | | 11/1994 | Mardikian | 114/363 |
| 5,427,049 | A | | 6/1995 | Mardikian | 114/362 |
| 5,465,679 | A | | 11/1995 | Mardikian | 114/363 |
| 5,516,313 | A | | 5/1996 | Lumpkin | 440/39 |
| 5,622,132 | A | | 4/1997 | Mardikian | 114/144 |
| 6,168,481 | B1 | * | 1/2001 | Mardikian | 440/39 |

* cited by examiner

*Primary Examiner*—S. Joseph Morano
*Assistant Examiner*—Lars A. Olson
(74) *Attorney, Agent, or Firm*—Klein & Szekeres LLP

(57) ABSTRACT

A jet powered boat may be provided with a water monitor for fire fighting purposes. The conduit for the monitor is connected to an opening through the bottom of the hull to draw water vertically from beneath the hull. Two motors are provided in the boat. One motor is configured to propel water through the monitor conduit to the water monitor. The other motor is configured to propel water through a propulsion jet at the rear of the boat. In one embodiment, a second propulsion jet is provided at the rear of the boat, connected to the conduit for the water monitor. A baffle at the intersection of the second propulsion jet and the monitor conduit may be operated to selectively direct water to either the monitor or the propulsion jet. In this embodiment, the two motors may be placed symmetrically on either side of the longitudinal centerline of the boat. In another embodiment, in which one motor exclusively supplies water to the water monitor (without the second propulsion jet), the two motors may be placed fore and aft along the centerline of the boat. The hull of the jet powered boat is shaped with progressively shallower segments of the hull bottom spaced farther from the hull centerline to provide the directional stability of a "V" shape near the centerline, with a relatively flat shape near the sides of the hull for lateral stability. Debris screens may selectively be placed in the water intake openings through the hull to block pump-damaging debris.

18 Claims, 10 Drawing Sheets

JET BOAT WITH IMPROVED HULL DESIGN AND ENGINE PLACEMENT

CROSS-REFERENCE TO RELATED APPLICATIONS

The present application is a continuation of application Ser. No. 09/137,899, filed on Aug. 20, 1998, to be issued as U.S. Pat. No. 6,168,481

STATEMENT REGARDING FEDERALLY SPONSORED RESEARCH OR DEVELOPMENT

Not Applicable

BACKGROUND

1. Field of the Invention

The present invention relates generally to powered water going vessels or boats, and particularly to relatively small, highly maneuverable, fast, jet powered boats. In further particularity, the present invention pertains to such boats used to provide emergency services, such as fire fighting, rescue, and emergency medical services, on water.

2. Background

A variety of jet powered water craft are currently available. Some are very large, very high-performance racing boats. Many are "personal water craft," distinguished by their small size, and a high degree of maneuverability. Typical of these personal water craft is that the operator position is centered on the craft, and the operator typically straddles the engine compartment. These boats draw water in through a water intake, and direct a jet of water out the rear of the boat to propel the boat forward. By changing the direction of the jet of water, the operator can change the direction of boat movement. Typically, these boats have a very shallow draft as they are propelled forward, as they skim along the surface of the water. However, these jet powered boats tend to be unstable when the weight on board shifts or changes, and they therefore do not generally have the stability necessary for them to be useful for providing work platforms, such as is required to perform rescue or emergency medical services.

A very different category of boat comprises a fire and rescue boats. Such boats are used by emergency medical personnel to rescue people who are injured or otherwise incapacitated while engaging in water sports. These boats may also include the capability of pumping water from around the boat and directing a stream of that water onto a burning boat, water-side building, or other target. The boats used for emergency services are typically relatively large, displacement style boats that continuously displace a volume of water having weight equivalent to the weight of the boat itself. Thus, these boats all are relatively slower than are jet-powered boats. However, the displacement type boats tend to be extremely stable, and may provide reliable work platforms for use in rescue, medical aid, patient transportation, and fire fighting purposes.

For fire fighting purposes, emergency response boats draw water through an intake on the side of the hull, pump it through a conduit to one or more monitors located on the upper portion of the hull. These monitors typically have movement in three axes so that the stream of water from the monitor may be directed as desired by the fire fighting personnel. Rescue and medical aid boats have flat deck space to carry stretchers for injured or ill persons, and to provide surfaces on which the medical or rescue personnel may perform their work.

The popular jet powered personal water craft have proven to be less than ideally suitable for many fire and rescue and other emergency services. One of the chief drawbacks has been that the hull design, which renders the boat extremely fast and maneuverable, also tends to contribute to instability in the craft. Such instability makes it difficult for emergency response personnel to attend to the various emergency duties, since they must constantly be concerned with tipping the craft. Furthermore, typically such boats do not have room to accommodate emergency equipment, and particularly not injured persons for transport. In yet another drawback, the forces of drawing water into the hull to use in fire fighting tends to destabilize the boat.

If the above problems with jet-powered boats could be resolved, such boats could be quite useful as emergency response boats. The high speed of small jet-powered boats would allow emergency personnel to reach an emergency situation rapidly. In addition, the very shallow draft (and absence of propellers protruding below the hull) allows the boat to reach areas where conventional boats cannot operate.

SUMMARY OF THE INVENTION

The present invention is a jet powered boat having a unique hull design that provides a high degree of stability at high speed and in rough water, while still allowing the boat to be operated at high speeds. The jet powered boat of the present invention additionally includes unique engine placement and a unique hull opening through the bottom of the hull to provide improved stability. The hull opening allows water to be drawn into a water delivery system for uses such as fire fighting. The hull opening is in the bottom of the hull to allow water to be drawn from beneath the craft so that does not affect the stability of the craft.

In particular, the present invention is an improved jet powered boat. The jet powered boat comprises a hull, a fluid jet conduit having an intake along the bottom of the hull and a jet outlet at the rear of the hull, and a drive motor for propelling water from the intake through the conduit to the jet outlet. An operator control station within the hull contains controls for the drive motor and the jet outlet. The improvement of the present invention includes an outlet water monitor mounted on top of the hull. The water monitor may be moved to direct a stream of water in any of a plurality of directions. A hull opening is provided through the bottom of the hull, and a water conduit connects the hull opening to the outlet monitor. A pump engine connected to the water conduit draws water through the conduit from the hull opening to the outlet monitor.

In accordance with one embodiment of the invention, the improved jet powered boat includes a second propulsion or conduit intersecting the water monitor conduit at point between the pump motor and water monitor. The second propulsion water conduit has a second propulsion outlet at the rear the hull. A movable baffle in the monitor water conduit at a point at which the monitor water conduit and the second propulsion water conduit intersect is movable between a first position and a second position. When the baffle is in the first position, the baffle directs water through the monitor conduit, but substantially restricts the flow of water through the second propulsion conduit. When the baffle is in the second position, the baffle directs water into the second propulsion conduit.

The jet powered boat of the present invention includes a unique progressive "V" hull shape that provides lateral stability and directional stability, and provides flat upper surfaces for work platforms and patient transportation.

In accordance with a further aspect of the present invention, a debris screen may be selectively placed in the propulsion intake opening through the hull, through which the propulsion motor draws water for propulsion purposes.

DETAILED DESCRIPTION OF A PREFERRED EMBODIMENT

The present invention is a jet-powered water going vessel, or boat, suitable for use in emergency services, such as fire fighting and rescue operations.

Figure 1:
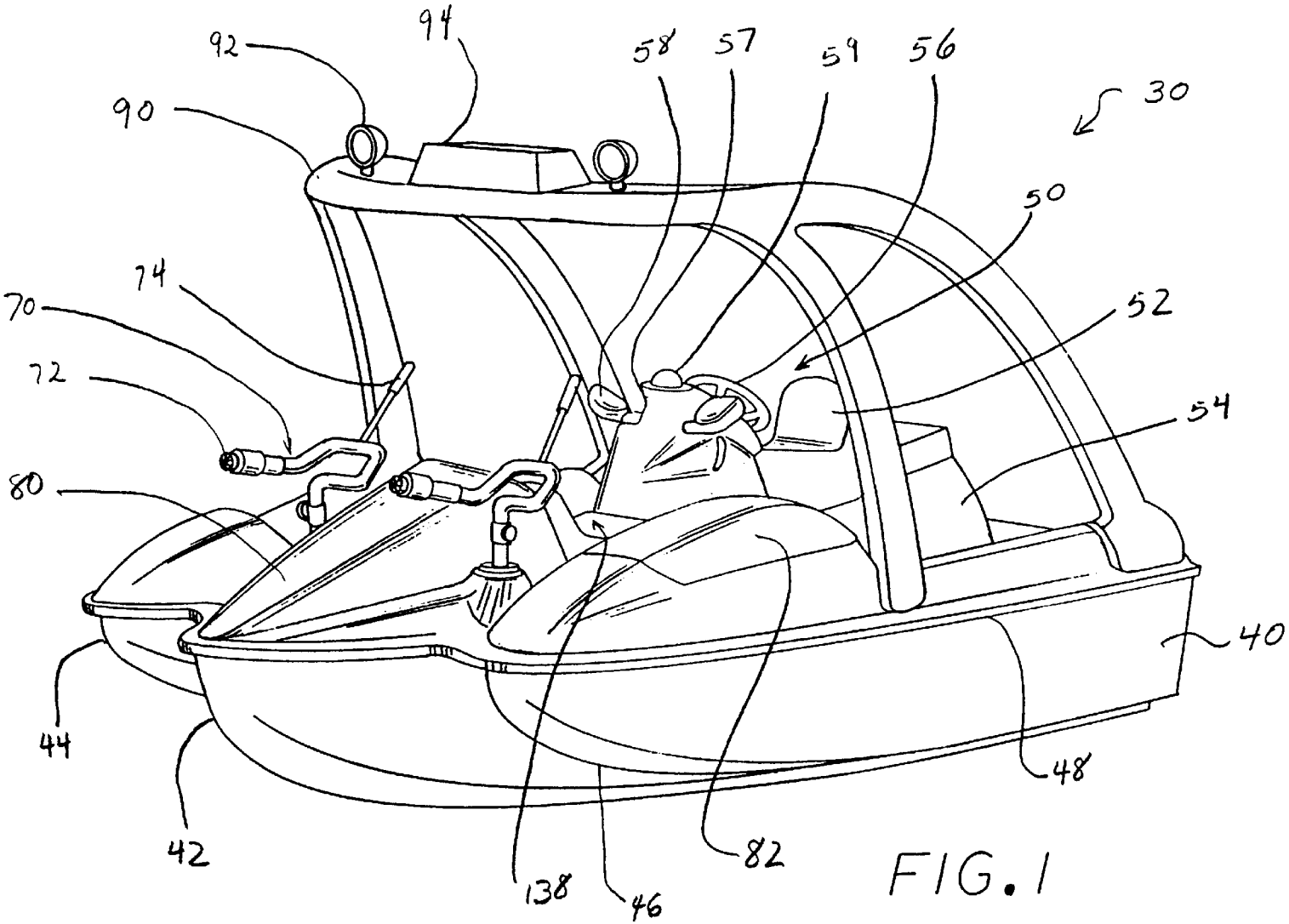
FIG. 1 is a perspective view of a preferred embodiment of a jet powered boat incorporating the present invention.

Referring first to the perspective view of FIG. 1, a first embodiment of the boat 30 is shown. The boat 30 includes a hull 40. In accordance with one aspect of the present invention, the hull 40 has a unique shape to provide a high degree of stability when the boat is moving at high speed, is operated in rough waters, or is called upon to support rescue personnel and perhaps others. The hull may have a beam (width) at its widest point of approximately eight feet. The length of the hull of the illustrated embodiment may be, for example, twelve feet. However, those skilled in the art will recognize that other lengths and widths may be constructed incorporating the present invention, and other ratios of length to width may also be constructed. The hull 40 may be formed with a primary bow portion 42, and symmetrical secondary bow portions 44, 46. The unique shape of the hull 40 is described below in greater detail.

The hull 40 may be formed of fiberglass using conventional marine molding techniques. Those familiar with the art will recognize that the hull 40 may also be formed of other materials, including plastics. A bumper 48 may surround the edge of the hull 40. The bumper may be formed of rubber or a soft plastic. The bumper helps protect the sides of the hull from damage when the boat 30 comes into contact with other boats, docks, pilings, or other items (not shown). An air-filled flotation bumper may also be used.

The boat includes an operator station 50. The operator station 50 may include a seat 52 straddling the engine compartment cover 54. Steering control such as a steering wheel 56 is provided forward of the seat 52. Those skilled in the art will recognize that "motorcycle style" handle bars (not shown) may be used in lieu of the steering wheel 56. An instrument panel (not shown) may be positioned adjacent the steering control 56. For example, the instrument panel may be placed on the cowling 57. The instrument panel may include instrumentation such as engine temperature gauges, engine speed gauges, fuel or other quantity gauges, lighting controls, etc. Instrumentation may further include a compass housed within a compass housing 59 at the top of the instrument panel.

Controls (not shown) for the motor or motors of the boat may also be included on or adjacent the cowling 57. (The motors are described below.) In many circumstances, it is advantageous to have rearward viewing equipment, such as rear view mirrors 58, for the operator. The rear view mirrors 58 allow an operator seated in the seat 52 to see toward the rear of the boat 30 without turning around.

On either side of the operator station 50 may be deck space (not shown) on the surface of the hull. Such deck space is preferably substantially horizontal. It provides a surface on which crew members (not shown) may stand and work, and upon which injured or ill victims may be placed for treatment or transportation. In particular, an area of horizontal deck space on each side of the boat operator station 50 may be of sufficient size to receive a stretcher or patient transport board (not shown). Such space will allow the boat to transport injured persons to medical facilities for treatment. Larger hulls provide more space to permit greater deck space areas.

One or more upper water monitors 70 may be provided on the upper side of the hull. The water monitors 70 may be used to apply a spray or stream of water to a target. For example, a stream of water may be directed toward a burning boat or water-side building for fire fighting purposes. The illustrated embodiment includes two upper water monitors. In the illustrated embodiment, these two water monitors are identical to one another. Thus, the same reference numeral 70 is used to identify both. Those skilled in the art will recognize that in certain instances a single monitor may be sufficient, or there may be circumstances in which more than two monitors are desired. When a single monitor is included, the single monitor is preferably positioned along the longitudinal centerline of the deck of the boat.

Each water monitor 70 includes an outlet port or nozzle 72 through which a stream of water may be directed. Preferably, each water monitor 70 may be manipulated in three axes of movement, so that a stream of water exiting the outlet nozzle port 72 may be directed in any of a plurality of directions, as may be needed in different circumstances. This movement may be provided by having a ball pivot (not shown) at the base of the monitor, where the monitor 70 enters an upper surface or deck 80 of the hull 40. A handle 74 attached to each monitor may be manipulated by an operator (not shown) to move the monitor 70. In addition, or in the alternative, the position and orientation of the monitor 70 may be controlled electrically, hydraulically, or mechanically. Such electrical, hydraulic, or mechanical control may be manipulated from either the primary operator station 50 or from the secondary operator station 138.

An upper surface or deck 80 of the hull may enclose a portion of the hull volume. The upper hull surface or deck 80 is also formed of fiberglass, using conventional manufacturing techniques. The edges of the upper hull surface 80 are securely affixed to the edges of the lower hull portion 40. In certain instances, the upper hull portion 80 and the lower hull portion 40 may be molded as a single continuous piece of material.

Figure 11:
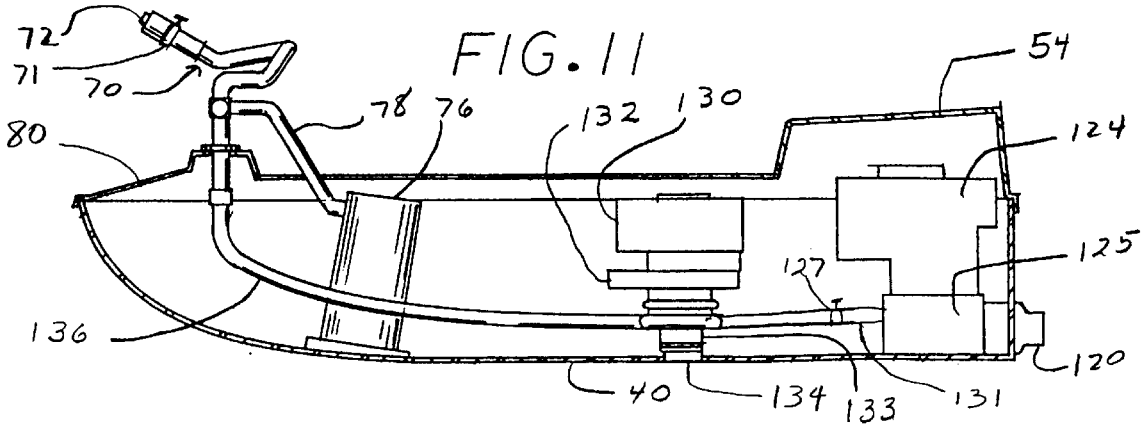
FIG. 11 is a cross-sectional view of a portion of a pump incorporated in one aspect of the present invention.

The portion of the hull enclosed by the upper hull portion 80 may contain a variety of equipment and spaces. For example, one or more tanks 76 (see FIG. 11) for holding foam or other fire fighting chemicals may be placed within the portion of the hull enclosed by the upper surface 80. As will be familiar to those familiar with fire fighting equipment, foam or other chemicals may be mixed with water flowing through a monitor such as the monitor 70 to enhance fire fighting capabilities in certain circumstances, such as when flammable fluids are present. This mixing may be accomplished by connecting a foam conduit 78 from the foam tank 76 to the monitor 70. (The foam conduit 78 is shown in the illustration of FIG. 11.) In many applications, the foam conduit 78 is formed of flexible tubing so that as the monitor 70 is rotated and tilted, the foam conduit can follow along. In a particular embodiment, two 5 gallon foam or chemical tanks 76 may be included in the space enclosed by the upper hull surface 80. One tank may be connected to each monitor 70.

Flotation foam (not shown) may also be included in the portion of the hull enclosed by the upper hull surface 80. Such flotation foam provides additional buoyancy to the boat hull. Such flotation foam in the upper regions of the hull may provide sufficient buoyancy to help make the boat self-righting if it should turn over in the water.

A portion of the upper hull surface may be hinged to form an openable cover 82. The cover 82 may be hinged along one side. This openable cover 82 provides access to the interior of the hull. A portion of the hull interior beneath the openable cover may be a separately enclosed portion of the hull, or container within the hull to house rescue, medical, or other equipment. Preferably, the hinged cover 82 mates with the remainder of the upper hull surface 80 with a watertight seal, to minimize or eliminate the entry of water into the interior of the hull. Additional openable covers (not shown) may be formed from other portions of the upper hull surface. For example, a second hinged cover (not shown) substantially identical to the hinged cover 82 may be formed from a portion of the upper hull surface on the opposite side of the boat 30.

The engine cover 54 near the rear of the boat comprises a portion of the upper hull surface. Preferably, the engine cover 54 is separately removable, to provide access to the engines in the hull.

A secondary operator station 138 may be included forward of the primary operator station 50. From the secondary operator station 138, personnel can operate and control the monitors 70. Other controls may also be provided at the secondary operator station 138. Some of those additional controls are described below.

An overhead light bar 90 may be attached to the deck 80, which is attached to the hull 40, to provide a mounting platform for work lights 92, flashing emergency lights 94, and perhaps other equipment. For example, fire extinguishers (not shown) may be mounted on the vertical supports for the light bar 90. In addition, a siren or loudspeaker (not shown) may also be mounted on the light bar 90. Those familiar with lighting structures will also recognize that the work lights 92 may be mounted in fixed positions, or on swivel or pivoting mounts (not shown) so that they can be turned or tilted to provide light in a variety of directions. The overhead light bar may have a flotation foam core to assist in self-righting the boat 30 if it should turn over in the water.

Figure 2:
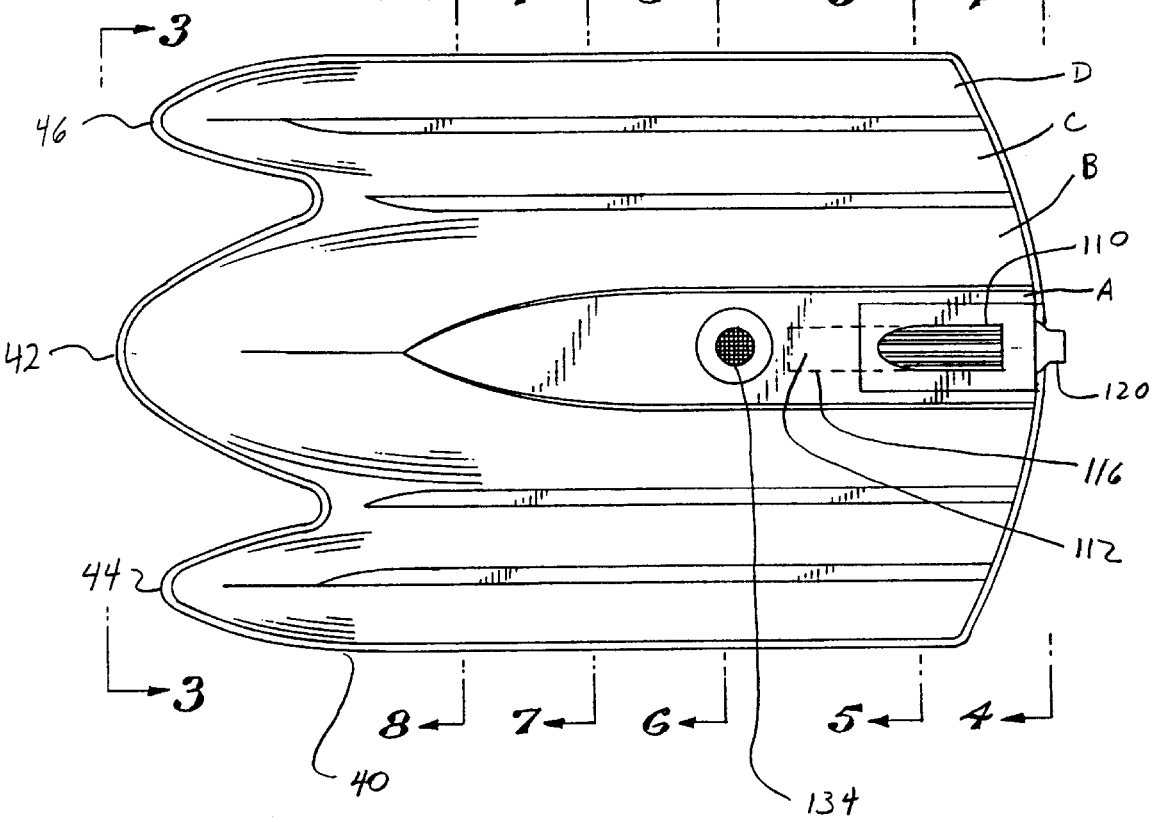
FIG 2 is an elevational view of the bottom of the hull of the boat shown in FIG. 1.
Figure 3:
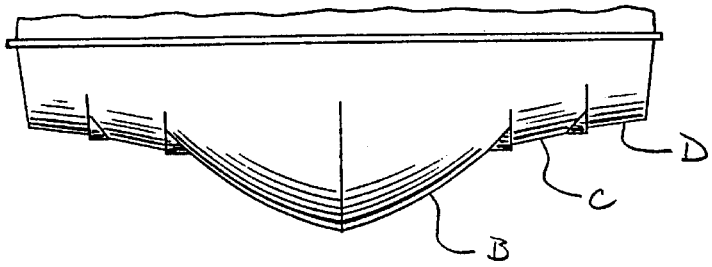
FIG. 3 is a front elevational view of the hull of the boat shown in FIG. 1, taken along the 3—3 of FIG. 2.

Referring next to FIG. 2, the bottom of the hull 40 is shown. Propulsion of the boat is provided by a propulsion system that includes an intake opening 110, an outlet jet 120, and a water conduit (not shown) connecting the intake opening 110 and the outlet jet 120. Arrangements for mounting and controlling the propulsion engine and the jet mechanism are well-known in the jet propelled boat arts.

The water intake opening 110 for the propulsion system may be near the rear of the hull. This intake opening 110 is provided through the bottom of the hull. In the illustrated embodiment, the propulsion intake opening 110 is along the hull's longitudinal centerline. The jet propulsion outlet 120 extends through though rear of the hull.

A propulsion motor 124 (FIGS. 10 and 11) is connected to the propulsion conduit through a pump 125 to draw water through the propulsion conduit from the intake opening 110 to the outlet jet 120. The propulsion motor (through the pump 125) substantially accelerates the water through the conduit so that the water can be directed out the outlet jet 120 at a high speed. The speed with which the motor directs the water out of the outlet jet 120 determines the speed of the boat. Throttle controls are provided at the operator station 50 to control the speed of the propulsion motor 124.

In addition, the outlet jet 120 may be pivoted from side to side to control the direction of the water stream flowing out of the outlet jet. By a changing the direction of the water being pushed out of the outlet jet, the direction in which the boat is being propelled can be changed to turn the boat. The steering control 56 (FIG. 1) at the operator station 50 is connected to the outlet jet 120 in a manner known in the jet propelled boat arts to control the direction of the jet 120.

The propulsion engine may be a conventional marine engine, such as a 175 horsepower marine engine available from Mercury Marine as the Sport Jet 175XR$^2$. Similar engines are available from other suppliers. The jet propulsion system eliminates the need for a propeller protruding from the bottom of the hull 40. Propellers tend to get fouled on debris, and also increase the depth of the water needed for the boat to operate. Thus, the boat 30 can get into places that a conventional propeller driven boat could not.

Figure 20:
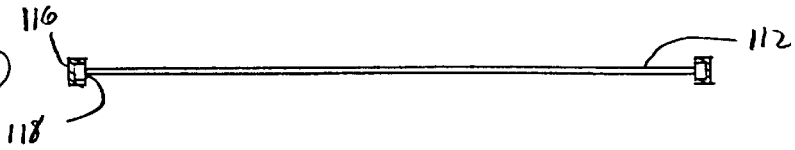
FIG. 20 is a cross-sectional view of the debris cover of FIG. 19, taken along line 20—20 of FIG. 19.
Figure 19:
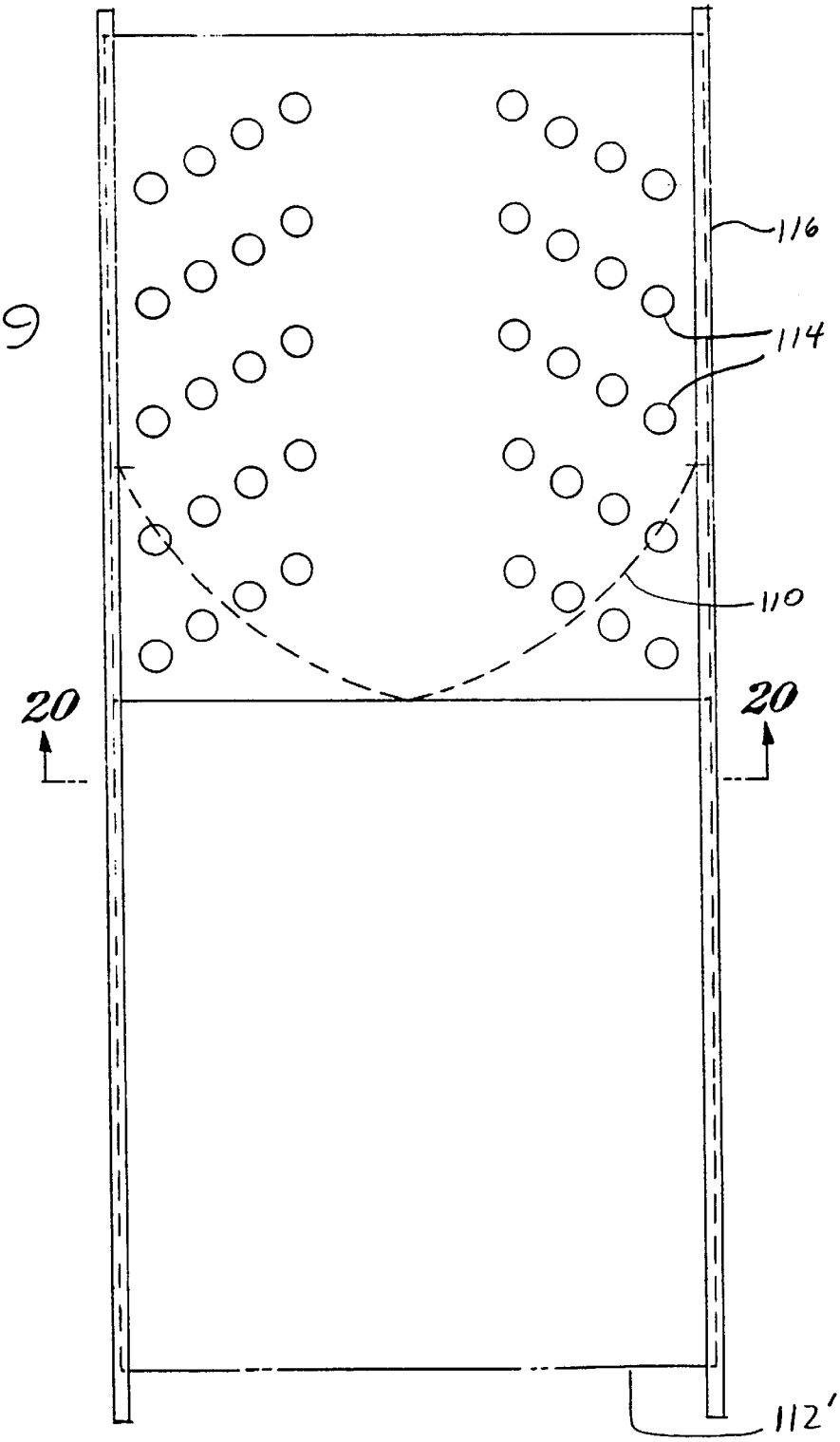
FIG. 19 is a view of a debris cover for a water intake opening in a hull of a jet propelled boat, in accordance with an aspect of the present invention.

It is a novel feature of the boat of the present invention to include a debris screen that may be selectively placed in the propulsion intake opening 110. Referring now to FIGS. 19 and 20, an exemplary embodiment of the debris screen 112 may be slidably fitted in the propulsion intake opening 110. The debris screen 112 helps to prevent debris from passing through the intake opening to the propulsion pump 125. The screen 112 filters out debris that is of such a size that it may damage the pump. The screen 112 may be formed of wire mesh or of a sheet of perforated metal. The size of the mesh or of the perforations selected will depend on the tolerance of the particular pump to debris, and the size of debris that should be kept from pump.

The debris screen 112 supplements a slotted screen that may conventionally be placed in the propulsion intake opening 110. The conventional slotted screen in the propulsion intake opening typically has longitudinal slots that are sufficiently large that they may not completely filter out potentially pump damaging debris. The conventional slots are large, to permit adequate water flow for high-speed operation of the boat.

In a preferred form, the screen 112 may be selectively placed in, or withdrawn from, the intake opening 110. Such selective placement allows the operator of the boat to choose whether to put the screen 112 in the intake opening 110. For example, when the boat 30 is traveling through clean water, the screen 112 may be withdrawn from the intake opening 110. With the screen 112 withdrawn, water flow through the intake opening 110 is maximized, which allows maximum propulsive force. However, when traveling through "dirty" water (water that may have pump damaging debris), the operator of the boat may choose to place the screen 112 in the intake opening 110 to protect the pump 125 against damage. Such "dirty" water may be found as the boat approaches the scene of a fire or accident, as there may be in the water debris from the fire or accident.

Referring to FIGS. 19 and 20, an exemplary movable screen 112 is illustrated. The screen of the particular embodiment illustrated comprises a plate of metal having a plurality of perforations 114 through the plate. The perforations 114 may be as small as ⅛ inch in diameter, up to several inches in diameter. The openings 114 should be large enough to permit adequate passage of water through the openings 114. However, they are typically smaller than about two to three inches in diameter, to block pump damaging debris. The openings 114 may be circular in shape, square, rectangular, or virtually any other shape.

The perforated sheet 112 has on each of its longitudinal sides a guide 118 that fits into a U-shaped channel 116 that is formed on the bottom of the hull. The guide 118 slides in the channel 116 to permit the perforated sheet 112 to slide along the length of the channel 116. The channels 116 thus are substantially parallel one another. Preferably the channels 116 are substantially longitudinal with respect to the hull, so that the perforated sheet 112 slides longitudinally with respect to the hull. The channels 116 may be formed either along the inner surface of the hull, or on the outer surface. In FIG. 19, the outline of the perforated plate 112 is illustrated in phantom lines 112' in its position withdrawn from the intake opening 110.

Preferably, the channels 116 are formed of metal. The channels 116 may be molded into the fiberglass of the boat hull, or may be formed as part of a metal plate (not shown) forming a section of the hull.

An electric motor or mechanical actuator (not shown) may be provided to slide this screen 112 along the channels 116 into or out of the intake opening 110. The electric motor or mechanical actuator may be controlled by the operator from a control at the operator station 50. For example, the control for the electrical motor or mechanical actuator may be placed on or adjacent the cowling 57.

Figure 10:
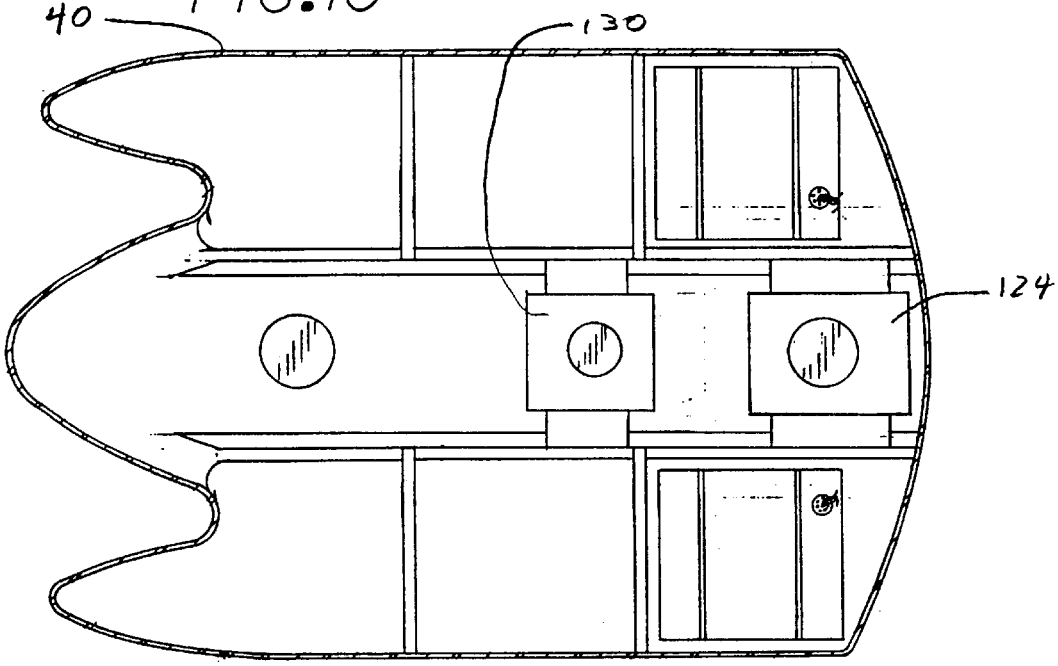
FIG. 10 is a view of the interior of the hull of the boat, partially in cross-section, taken along line 10—10 of FIG. 9.

It is another novel feature of the boat of the present invention to include a separate system draws water for the monitors 70 that are used for fire fighting purposes, as seen in FIGS. 10 and 11. This separate system draws water from beneath the hull 40, substantially vertically through a monitor intake opening 134 into a monitor conduit 136, to the upper monitor(s) 70. A pump engine 130, separate from the propulsion engine 124, drives a pump 132 that pulls the water through the monitor conduit 136. The pump engine 130 and pump 132 may be centrally positioned laterally in the hull for best balance of the boat. In particular, the pump engine 130 and the pump 132 are preferably positioned at the longitudinal centerline of the hull 40.

The monitor intake opening 134 is formed through the bottom surface of the hull 40. This provides that the water is drawn vertically into the monitor conduit, in contrast to other systems, which draw water from the side of the hull. Drawing the water vertically through the bottom of the hull tends to pull the boat hull 40 vertically downward without creating a horizontal force component. So avoiding a horizontal force reduces the tendency for the hull to become destabilized, and rotate, tip, or otherwise behave unpredictably during the pumping operation. The end portion 133 of the monitor conduit 136 that is adjacent the monitor intake opening 134 is preferably oriented vertically so that the water is drawn vertically through the monitor intake opening 134.

Preferably, the monitor intake opening 134 is located relatively nearer to the longitudinal centerline of the hull than it is to the sides of the hull. Positioning the monitor intake opening 134 relatively nearer to the center of the hull further minimizes any destabilizing tendencies that may arise during a pumping operation. In the particular embodiment illustrated, the monitor intake opening 134 is located along the longitudinal center line of the hull, for maximum equilibrium. The monitor intake opening 134 may be positioned anywhere along the length of the hull. In one particular embodiment, the monitor intake opening 134 is located approximately ⅔ to ¾ of the length from the bow to the stern of the hull. Thus, if the hull is approximately 12 feet in length, the monitor intake opening 134 may be located approximately eight to nine feet behind the bow 42. Unlike the propulsion intake opening 110, the monitor intake opening 134 is intended for use when the boat is substantially stationary in the water. Thus, the monitor intake opening 134 need not be shaped to draw water while the boat is traveling at high speed.

Figure 22:
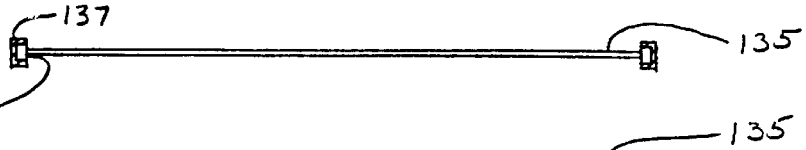
FIG. 22 is a cross-sectional view of the water intake opening cover, taken along line 22—of FIG. 21.
Figure 21:
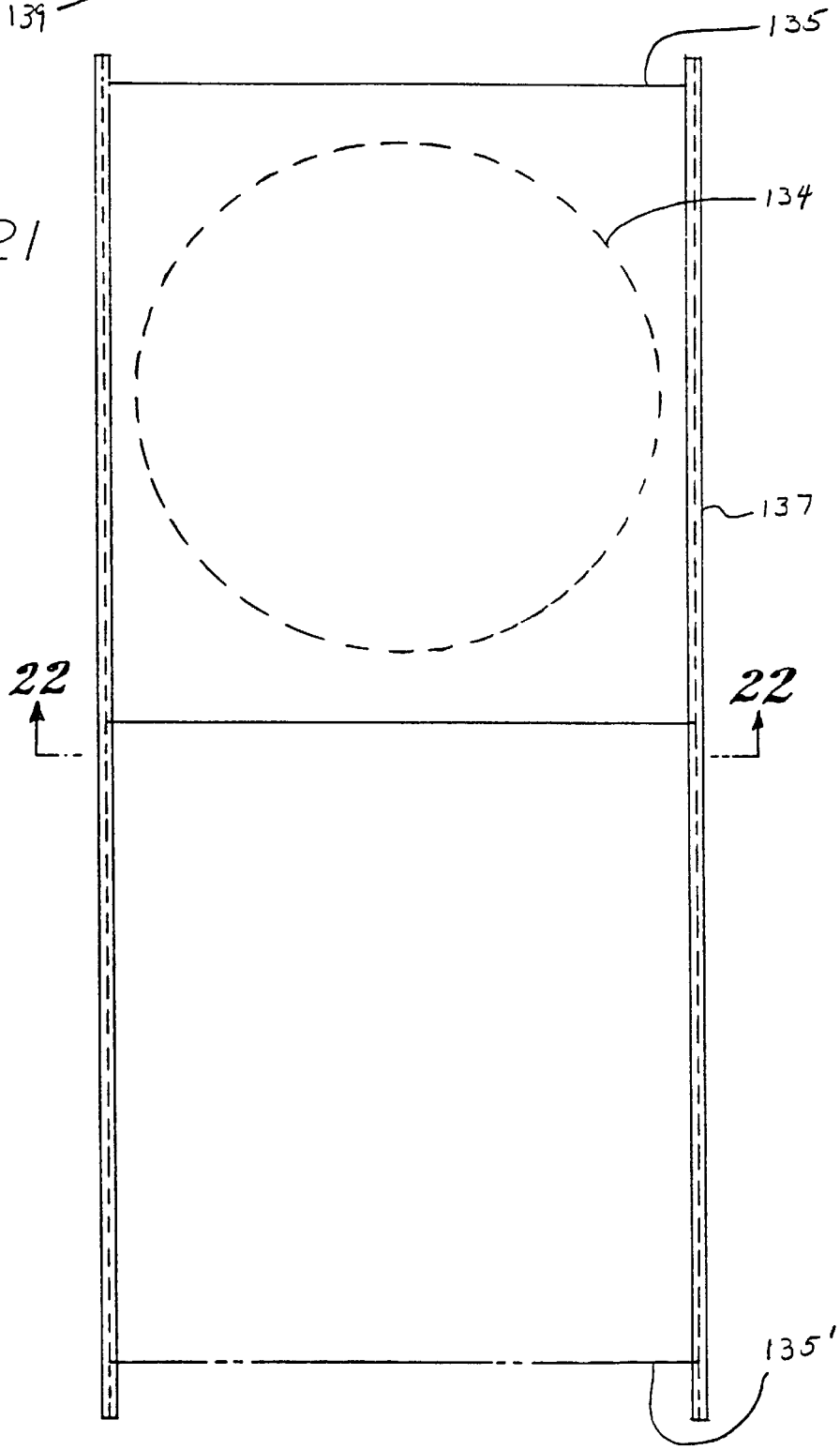
FIG. 21 is a view of an intake opening cover for closing a water intake opening in the hull of a boat, in accordance with another aspect of the present invention.

A screen may be fitted in the monitor intake opening 134 to keep debris from entering the opening and fouling the pump 132. In addition, a valve or cover may be included in the monitor intake opening 134. An exemplary embodiment of a cover 135 for the monitor intake opening 134 is shown in FIGS. 21 and 22. The monitor intake cover 135 may be a plate of metal or other rigid material. Guides 139 along the longitudinal edges of the plate 135 may fit within, and slidably engage, longitudinal tracks or channels 137. The channels 137 are formed in or attached to the hull. Preferably, the channels 137 are parallel one another, and extend longitudinally with respect to the length of the boat hull. FIG. 21 illustrates the plate 135 positioned to cover the monitor intake opening 134. Phantom lines 135' indicate the position of the plate 135 when the cover is moved to expose the monitor intake opening 134 to the water, so that water can flow in through the monitor intake opening 134.

Such a cover 135 can be used to keep water out of the pump system when the pump 132 is not operating. The cover is remotely operable, so the boat operator can open the intake 134 on demand. Such remote control may be provided by a mechanical linkage, or by electrical operation. The remote control may be provided either at the primary operator station 50, or at the secondary operator station 138 (see FIG. 1).

The monitor conduit 136 (FIG. 11) connects the monitor intake opening 134 to the monitor 70. Water can be drawn into the monitor intake opening 134, through the conduit 136 to the monitor 70, and out the monitor opening 72. The pump 132, driven by pump motor 130, is connected to the monitor conduit to draw the water into the monitor intake opening 134, and propel the water through the conduit 136 to the monitor 70.

The pump motor 130 may be a conventional marine engine. In one embodiment, a 25 horsepower, two stroke outboard marine engine available from suppliers such as Mercury Marine may be used. With a 25 hp two stroke engine, up to 500 gallons of water per minute may be supplied to the monitors 70 at a pressure of 60 pounds per square inch. Engines of other powers, including powers up to 175 horsepower, may be used for the pump motor 130. Clutch control of the pump motor 130 may be provided.

The pump 132 may be a conventional Hale pump. Those skilled in the art will recognize that a Hale pump may be readily attached to the output of an outboard marine motor 130. The speed at which the engine 130 is operated will govern the speed at which the pump 132 pumps water through the conduit 136. The pump 132 driven by the motor 130 provides the capacity to pump 200–1200 gallons per minute through the monitor conduit 136.

Controls for the pump motor 130 may be placed either at the primary operator station 50, or at the secondary operator station 138 immediately behind the water monitors 70. The controls may for; for example mounted on a cowling formed in the upper hull cover 80. Such controls may include a starter control and throttle.

Those familiar with the art will recognize that as the water leaves the forward facing monitor 70, a rearward pushing force tends to move the boat 30 backward. Thus, when directing water through the monitor 70, it is usually necessary for operator at the operator station 50 to operate the propulsion system to maintain forward propulsion, so that the boat remains in one place. In addition, as the monitors 70 are turned from left to right, it may be necessary for the operator at the operator station 50 to operate the steering mechanism 56 to adjust the direction of the propulsion jet from the outlet jet 120. Properly adjusted, the propulsion jet from the outlet jet 120 provides propulsion forces to counterbalance the forces provided by the water directed from the monitors 70.

The pump motor 130 may also be used to provide limited emergency propulsion if the propulsion motor 124 were to fail. The monitor 70 may be directed so that the stream of water from the monitor is directed at the water surface. The impact of the stream of water against the water surface creates thrust that will tend to move the boat across the surface of the water. By controlling the direction of the stream of water, the direction of thrust may be controlled to push the boat in the desired direction. This technique may be used, for example, to move the boat toward shore in the event that the primary propulsion motor 124 fails.

An additional water conduit 131 may connect the fire pump 132 and the propulsion pump 125 so that the fire motor 130 may direct water through the propulsion outlet 120. This allows the fire motor 130 to provide propulsion for the boat 30 if the primary propulsion motor 124 fails. The fire motor 130 (driving the fire pump 132) may draw water through the monitor opening 134, and through the pump connecting conduit 131 to propel the water out the propulsion conduit 120, thereby providing thrust to propel the boat through the water. The secondary conduit 131 may be connected to the propulsion pump to direct the water through the propulsion pump 125. Alternatively, the secondary conduit 131 may be connected directly to the outlet jet 120, bypassing the propulsion pump 125.

Valving may be included to selectively govern whether water drawn through the monitor opening 134 flows through the monitor conduit 136 to the monitor 70, or through the secondary water conduit 131 to the propulsion outlet 120. For example, the flow of water through the monitor 70 may be cut off by closing a valve in the monitor conduit 136. In particular, a monitor shut-off valve 71 may be provided adjacent the nozzle 72 of the monitor 70 to close the nozzle 72. The monitor shut-off valve 71 may be a 2-way ball valve that is electrically or mechanically operated. With the monitor shut-off valve 71 closed, water drawn through the monitor intake 134 flows through the secondary conduit 131 to the outlet jet 120, providing propulsion for the boat. Similarly, an electrically or mechanically operated ball valve 127 may be included in the secondary conduit 131, between the fire pump 132 and the outlet jet 120. With the secondary conduit shut-off valve 127 closed, water drawn through the monitor intake 134 flows through the monitor conduit 136 to the monitor 70, to provide water for fire fighting. Because the monitor intake 134 is not designed to draw in large quantities of water when the boat is moving at high speed, using the fire pump 132 driven by the fire pump engine 130 to pump water through the secondary conduit 131 to provide propulsion for the boat will generally provide relatively low-speed movement for the boat. Thus, that configuration is generally used only to propel the boat to shore or repair facilities when the primary propulsion engine 124 fails.

In the particularly preferred embodiment illustrated, both the propulsion motor 124 and the pump motor 130 are positioned along the longitudinal centerline of the hull 40. The central location of the motors provides improved balance for the boat 30. In addition, the motors may be mounted vertically, with the drive shaft oriented vertically, and emerging from the bottom of the motor mounting. Such a vertical arrangement of the motors minimizes the longitudinal space consumed by the motors, allowing a more compact design for the boat structure. The motors 124, 130 may also be mounted horizontally. Furthermore, one motor may be mounted vertically, and the other horizontally.

Figure 12:
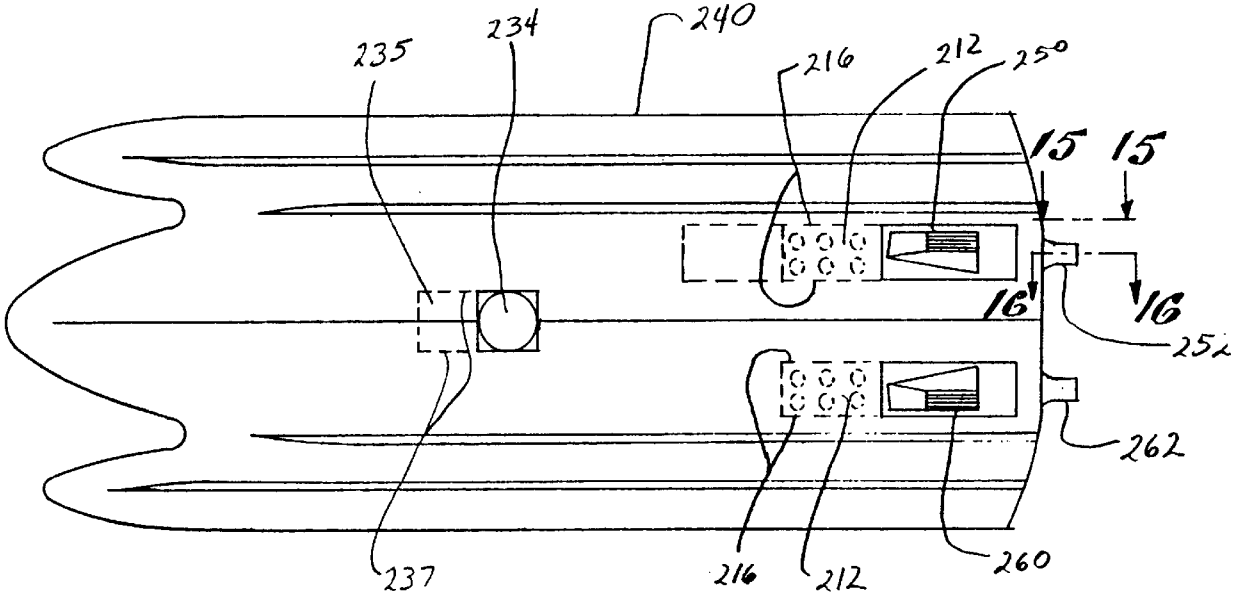
FIG. 12 is a bottom elevational view of an alternative embodiment of the hull of a jet-powered boat incorporating the present invention.
Figure 18:
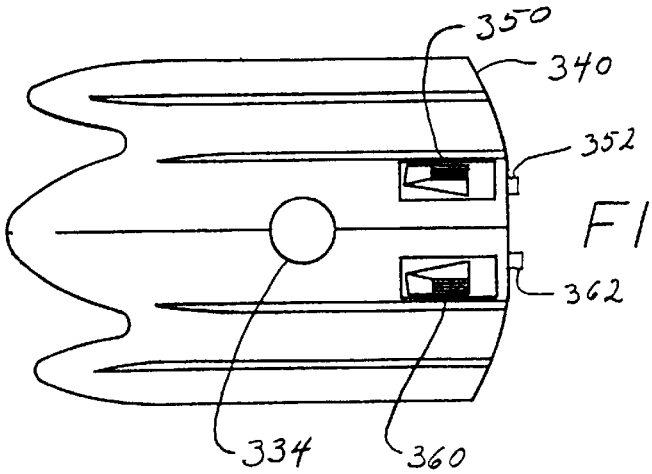
FIG. 18 is a bottom elevation of view of a third embodiment of the hull of a jet powered boat incorporating the present invention.

FIG. 12 shows the bottom of the hull of an alternative embodiment of the boat incorporating the present invention. The embodiment specifically illustrated in FIG. 12 is a hull 240 that has a beam (width) of approximately ten feet, and is 26 feet in length. However, those skilled in the art will recognize that other dimensions of hulls may also be used. For example, FIG. 18 illustrates a variation of this embodiment configured on a hull that is approximately 12 feet in length and eight feet in width.

The boat incorporating the hull 240 may have an upper portion that is substantially similar in configuration to the upper portion of the boat shown in FIG. 1 (although somewhat longer and wider). Because of their similarity to the features illustrated in FIG. 1, they are not separately illustrated here. In particular, the boat may have an operator station similar to the operator station 50, and one or more upper water monitors similar to the upper water monitors 70.

Figure 14:
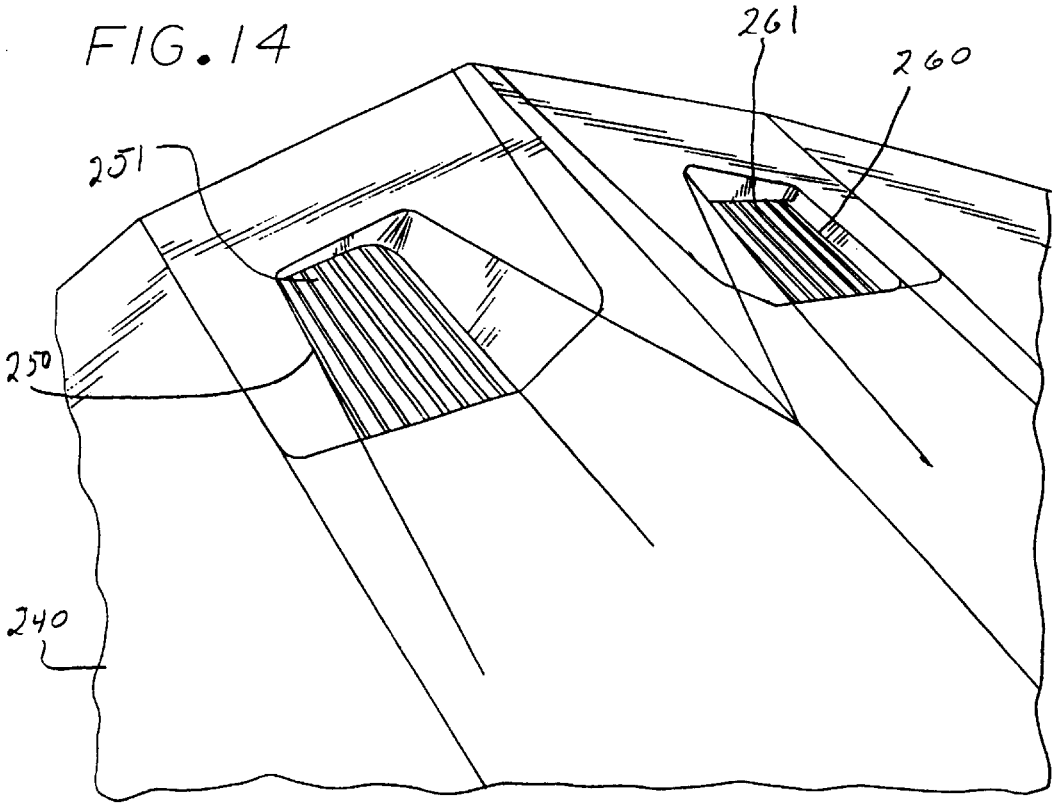
FIG. 14 is a perspective view of a portion of the bottom of the hull embodiment shown FIG. 12.

In accordance with still another novel aspect of the present invention, the hull of this embodiment has two propulsion water intake openings 250, 260 through the bottom of the hull 240. In a particularly preferred arrangement, the propulsion intake openings 250 and 260 are located relatively near to the stern of the hull 240. For example, each propulsion intake opening may be approximately one foot to two feet from the rear of the hull. Each intake opening 250, 260 may be approximately 12–24 inches long, and approximately 6–12 inches wide. The intake openings 250, 260 may be symmetrically placed relative to the longitudinal centerline of the hull. In further particularity, the edge of each propulsion intake opening may be between six inches and 24 inches from the centerline. A perspective view of the openings 250, 260 is shown in FIG. 14. As seen in FIG. 14, the openings 250, 260 may be recessed in the hull.

Consistent with conventional propulsion intake design for jet power boats, a slotted screen 251, 261 may be included in the respective propulsion intakes 250, 260. The openings through the slotted screens 251, 261 typically relatively large so that an adequate water flow may be maintained through the intake 250, 260 when the vessel is operating at high speed. In addition, the slots in the slotted screens 251, 261 are generally aligned with the length of the boat, to minimize their disruption of the flow of water through the propulsion intakes 250, 260. Thus, the slotted screens 251, 261 are likely to block the largest debris that might enter the intakes 250, 260.

Each of the propulsion water intake openings 250, 260 preferably includes a debris cover 212 that may be selectively placed in the intake opening, or removed from the intake opening. Each debris cover 212 may be substantially similar to the novel debris cover 112 illustrated in FIGS. 19 and 20, and described above. In particular, the debris cover 212 may be slidably mounted on a pair of parallel channels 216 that extend along the hull from adjacent the water intake openings 250, 260. The debris cover may comprise a screen or a perforated plate. An operator control (not shown) allows the operator to selectively place the debris cover 212 in the water intake openings 250, 260, or to remove the debris cover from the water intake opening.

The operator of the boat will typically choose to place the debris screen 212 in the intake openings 250, 260 only in circumstances in which the speed of the boat is reduced. Therefore, although the debris cover 212 may reduce the flow of water through the intake openings 250, 260, the reduced water flow is likely to be acceptable at the reduced speed of the boat.

Referring again to FIG. 12, two propulsion outlet jet openings 252, 262 are provided at the rear of the hull 240. The first outlet jet 252 is connected to the intake opening 250 by a propulsion conduit 254 (see FIGS. 15 and 16) to direct water from the intake opening 250 to the outlet jet 252. A similar propulsion conduit (not shown) connects the intake opening 260 to the second outlet jet 262.

Figure 13:
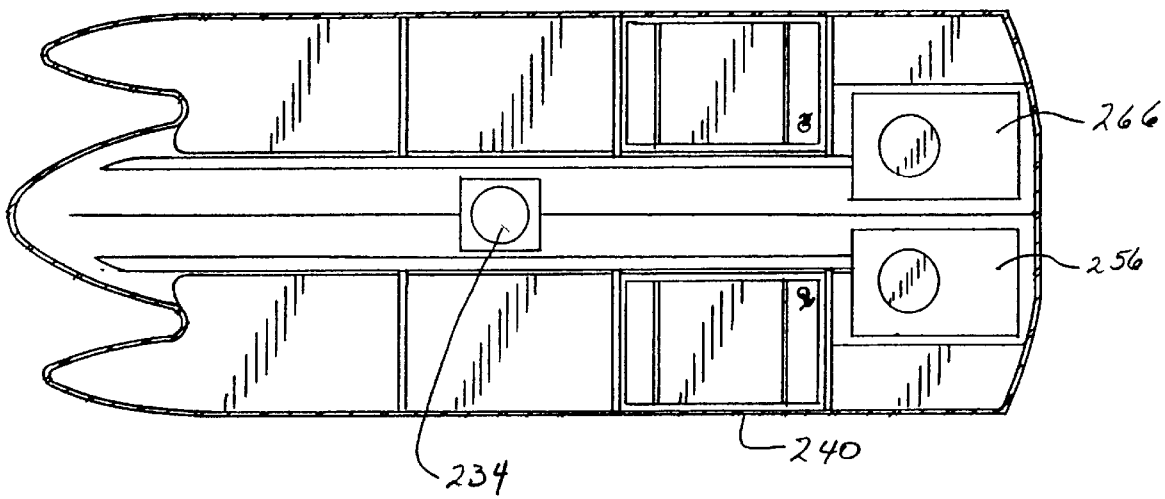
FIG. 13 is a view of the interior of the hull embodiment shown in FIG. 12.

Propulsion motors 256, 266 (FIG. 13) are connected to the propulsion conduits 254 for propelling water through the conduits from the intake openings 250, 260 to the outlet jets 252, 262. FIG. 13 is a top view showing the inside of the hull 240, including the approximate positions of the motors 256, 266. Note that because FIG. 12 is a view from the bottom, and FIG. 13 is a view from the top, the positions of the motors 256, 266 appear mirrored.

The motors 256, 266 are preferably identical to one another. Both motors can be conventional marine engines, such as 175 horsepower marine engines available from Mercury Marine as the Sport Jet 175XR$^2$. Similar engines are available from other suppliers.

The propulsion motors 256, 266 are preferably mounted vertically in the hull 240. Such vertical mounting of each engine provides a vertically oriented a drive shaft from the engine to power the pumps that directly propel the water through the propulsion conduits. A vertical configuration also reduces the amount of hull space occupied by the engines. However, those familiar with the art will recognize that the engines may also be mounted horizontally in the hull.

Figure 15:
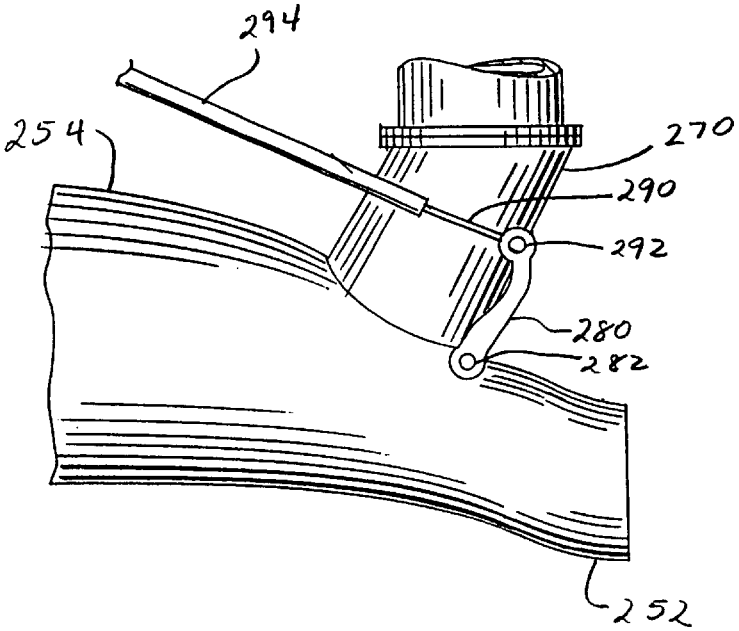
FIG. 15 is a view of a portion of the water conduits of the hull embodiment shown in FIG. 12

Referring now to FIG. 15, as still another novel aspect of the present invention, a monitor conduit 270 intersects the propulsion conduit 254. The monitor conduit 270 provides fluid communication between the propulsion conduit 254 and upper monitors (not shown) on the boat. The upper monitors are similar to the monitors 70 shown in the embodiment of FIG. 1. The point at which one end of the monitor conduit 270 intersects the propulsion conduit 254 is preferably along the propulsion conduit 254 between the propulsion motor 256 and the outlet jet 252. The other end of the monitor conduit 270 is connected to the upper monitors.

Figure 16:
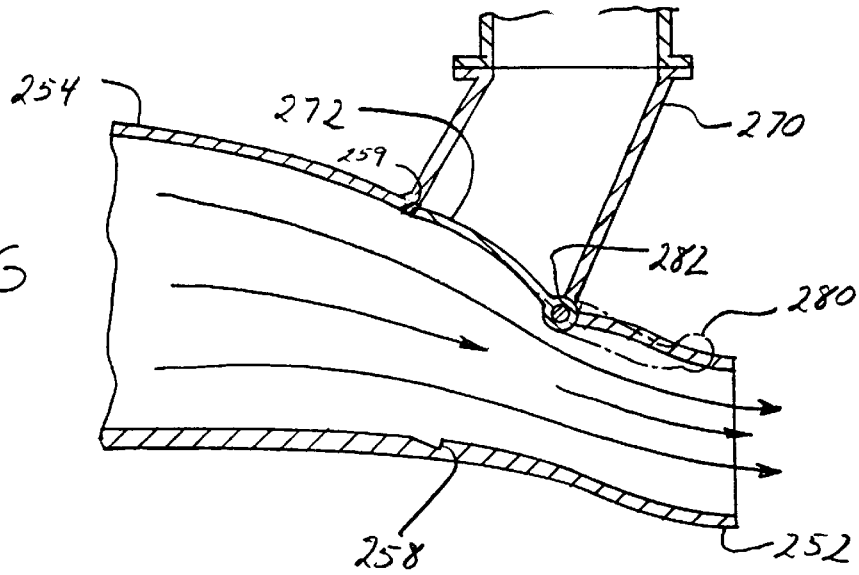
FIG. 16 is a cross-sectional view of a portion of the water conduits of the embodiment shown in FIG. 12, taken along lines 16—16 of FIG. 12.
Figure 17:
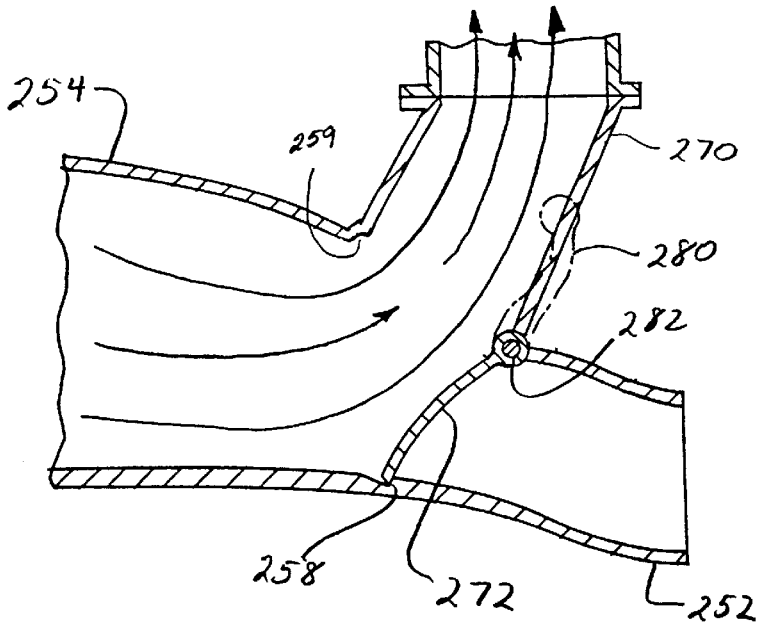
FIG. 17 is a view of the same portion of the fluid conduit shown in FIG. 16, with the baffle moved to its alternative position.

Referring now to FIGS. 16 and 17, the conduit 254 connecting the first intake opening 250 and the first propulsion outlet jet 252 includes a baffle 272. The baffle 272 selectively directs the flow of water to either the outlet jet 252 or the monitor conduit 270. The baffle 272 may be moved from a first position (shown in FIG. 17) to a second position (shown in FIG. 16). The baffle 272 rotates about a pivot point 282 that is located at or near the point at which the monitor conduit 270 and the propulsion fluid conduit 254 intersect. This pivot point is located at the downstream edge of this intersection.

When the baffle 272 is in the first position, the baffle directs water from the conduit 254 into the monitor conduit 270, and to the upper monitors on the upper portion of the boat hull, so that the water can be used for fire fighting or other operations. In this first, or monitor, position, the baffle 272 substantially restricts the flow of water to the propulsion outlet nozzle 252. In this first position, the baffle 272 is positioned across the propulsion conduit 254. When the baffle 272 is in this first position to direct the flow of water into the monitor conduit 270, the first motor 256 functions as a pump motor, in a manner similar to the pump motor 130 of the first embodiment described in connection with FIGS. 1–11. Thus, the first motor may be used to control the flow of water through fire fighting monitors, while the second motor 266 continues to direct a flow of water to the second jet outlet 262 to control the position of the boat.

However, when water is not needed from the upper monitors for fire fighting, the baffle 272 may be moved to its second position (shown in FIG. 16), in which it directs the flow of water from the first intake opening 250 to the propulsion jet outlet 252. In this second, or propulsion, position, the baffle 272 is positioned across the monitor conduit 270, and substantially blocks the flow of water into the monitor conduit 270. In this configuration, both engines 256, 266 can provide propulsion to the boat. Using both engines for propulsion may provide greater speed for the boat, allowing it to arrive at the scene of an emergency more quickly.

As illustrated in FIGS. 16 and 17, the baffle 272 may be slightly curved to provide increased strength against the pressure of the water flowing through the conduit 254. The baffle 272 is subjected to its highest stresses due to water flow when the baffle is in its first position, directing the water flow from the outlet jet 252 into the monitor conduit 270. Therefore, the baffle 272 may be curved so that its convex side faces the water flow when the baffle is in that position. In addition, as the conduit 254 becomes constricted in diameter as it approaches the outlet propulsion jet 252, the contour of the baffle 272 may follow the contour of the conduit 254. As those skilled in the art will recognize, the reduced diameter of the conduit as it approaches the propulsion outlet 252 helps to increase the speed of the water flowing through the conduit, thus increasing its propulsive capabilities.

A notch 258 in the wall of the conduit 254 provides a secure stop for the baffle 272 when the baffle is in the first position. The free end of the baffle can rest against the notch, which prevents the baffle from rotating further into the outlet jet 252. Those skilled in the art will recognize that the force of the water as it is directed from the conduit 254 into the monitor conduit 270 is likely to be quite substantial. Therefore, the baffle 272 must securely seat in the conduit 254 to provide its directional function. An additional notch 259 may be provided in the wall of the monitor conduit 270. The second notch 259 provides a secure stop for the baffle 272 when the baffle is in the second position, across the monitor conduit 270.

A control mechanism connects the baffle 272 with a boat operator station so that an operator can control the position of the baffle 272. The control mechanism may be operated from either the primary operator station, such as is similar to the primary operator station 50 shown in FIG. 1, or from the secondary operator station, such as is similar to the secondary operator station 138 shown in FIG. 1. Different types of control mechanisms may be used. For example, an electrical connection (not shown) may be provided, with an electric motor (not shown) used to rotate the baffle 272 between its positions. A simple mechanical linkage may also be used.

Referring back to FIG. 15, a mechanical linkage is illustrated for governing or controlling the position of the baffle 272. A handle 280 is connected to a lever arm 290. One end of the handle 280 is securely affixed to a shaft 282 that defines the pivot point of the baffle 272. Thus, as seen in FIGS. 16 and 17, in which the handle 280 is shown in phantom, movement of the handle 280 corresponds exactly with movement of the baffle 272. In the illustrated embodiment, a lever arm 290 connects to the other end of the handle 280. This second end of the handle 280 pivots about the end 292 of the lever arm 290. The other end of the lever arm 290 is located at a control panel, which may be at one of the operator stations. By operating a lever arm 290, the boat operator may change the position of the baffle 272, which changes the direction of the water flowing through the conduit 254. Thus, operation of the lever arm 290 changes the function of the motor 256 from providing propulsion force to providing water supply to upper monitors similar to the monitors 70 (see FIG. 1) for uses such as fighting fires. The movement and position of the lever arm 290 may be controlled electrically, hydraulically, or mechanically. In addition, other types of electrical, hydraulic, and mechanical controls for governing the position and movement of the handle 280 will be apparent to those skilled in the art, having been provided the above teachings.

The lever arm 290 may be housed within a sheath 294. To cause the first motor 256 to provide propulsion power for the boat, the lever arm 290 is extended. When the lever arm 290 is extended, the lever arm pushes the end of the handle 280. The handle and baffle 272 rotate about the pivot point 282 so that the baffle 272 closes off the monitor conduit 270. When the lever arm 290 is retracted, it pulls the end of the handle 280 upward. This movement of the handle 280 rotates the baffle 272 into the first position shown in FIG. 17 in which water propelled by the engine 256 is directed into the monitor conduit 270.

When the first motor 256 is being operated to supply water to the fire fighting monitors, the second motor is operated to direct a propulsive flow of water from the second outlet jet 262. The propulsive force of the flow of water through the second outlet jet 262 counteracts the force arising from the water being directed from the upper monitors on the boat. Because the second outlet jet 262 is slightly off-center longitudinally, the propulsive force of the water jet flowing from the outlet jet 262 will be slightly off center. Therefore, the operator at the primary operator station may need to turn the second outlet jet 262 slightly to maintain the boat in a straight ahead orientation.

A baffle similar to the baffle 272 could also be inserted into the other fluid conduit connecting the second fluid intake 260 and the second propulsion outlet jet 262. However, preferably the boat operator should always maintain water flow to at least one of the outlet jets 252, 262 to provide position control for the boat. Therefore, providing one conduit with the capability is generally sufficient.

For optimum performance in fire fighting operations, a monitor intake opening 234 is provided through the bottom surface of the hull, preferably substantially on the longitudinal centerline of the hull. A water conduit (not shown) connects the monitor intake opening 234 with the propulsion motor 256 so that the propulsion motor 256 may draw water through the monitor intake opening 234 and associated conduit.

For such optimum performance, the motor 256 draws water through the central monitor intake opening 234 for fire fighting purposes, while drawing water through the propulsion intake opening 250 for propulsion purposes. Thus, when the baffle 272 is in the first position shown in FIG. 16, the water is drawn through the propulsion intake opening 250. However, when the baffle 272 is in the second position (illustrated in FIG. 17), the water is drawn through the monitor intake opening 234, rather than the propulsion intake opening 250.

During fire fighting operations, when the boat is substantially stationary in the water, drawing water for fire fighting purposes through the central monitor intake opening 234 that is substantially along the hull centerline helps to maintain the balance and equilibrium of the boat.

In a preferred configuration, the monitor intake opening 234 and the section of the water conduit immediately adjacent the monitor intake opening 234 are oriented to cause water drawn into the monitor intake opening 234 to be drawn vertically. As described above in connection with the first embodiment of the boat illustrated in FIGS. 2, 10, and 11, drawing the water vertically through the bottom of the hull tends to pull the boat hull 240 vertically downward, without creating a horizontal force component. Avoiding a horizontal force while drawing water for fire fighting purposes allows the boat incorporating this feature to remain more stable during fire fighting operations that have boats of the prior art.

Selection of the intake opening through which the water is drawn (for propulsion or pumping) may be made by selectively placing plates or covers in the monitor intake opening 234 and the propulsion intake opening 250. Covering the monitor intake opening 234 while leaving the propulsion intake opening 250 open allows the motor 256 to draw water through the propulsion intake opening 250. Similarly, covering the propulsion intake opening 250 wall leaving the monitor intake opening 234 open allows the motor 256 to draw water through the monitor intake opening 234.

A monitor intake cover 235 may selectively cover the monitor intake opening 234. The monitor intake cover 235 is substantially similar to the monitor intake cover 135 illustrated in FIGS. 21 and 22. In particular, the monitor intake cover 235 is a solid plate that slides along a pair of substantially parallel tracks or channels 237. The channels 237 may be longitudinally oriented with respect to the hull.

An additional intake cover 218 is provided to selectively close off the propulsion intake opening 250. The propulsion intake cover 218 may be an extension of the debris cover 216, or may be a separate plate that is mounted on separate tracks or channels. In the embodiment in which the propulsion intake closure plate 218 is an extension of the debris cover 216, the cover therefore has three positions. In the first position (shown in FIG. 12), neither the debris cover 212 nor the cover plate 218 is over the opening 250, and the propulsion intake opening 250 is completely opened. This allows maximum water flow through the propulsion intake opening 250. In the second position, the debris cover 212 may be placed in the propulsion intake opening 250 to filter out debris and protect the motor 256 from debris that may be in the water that would otherwise be drawn into the propulsion water intake opening 250. In the third position, the cover plate 218 covers the propulsion intake opening 250 to completely or substantially block water flow into the intake opening 250.

Figure 23:
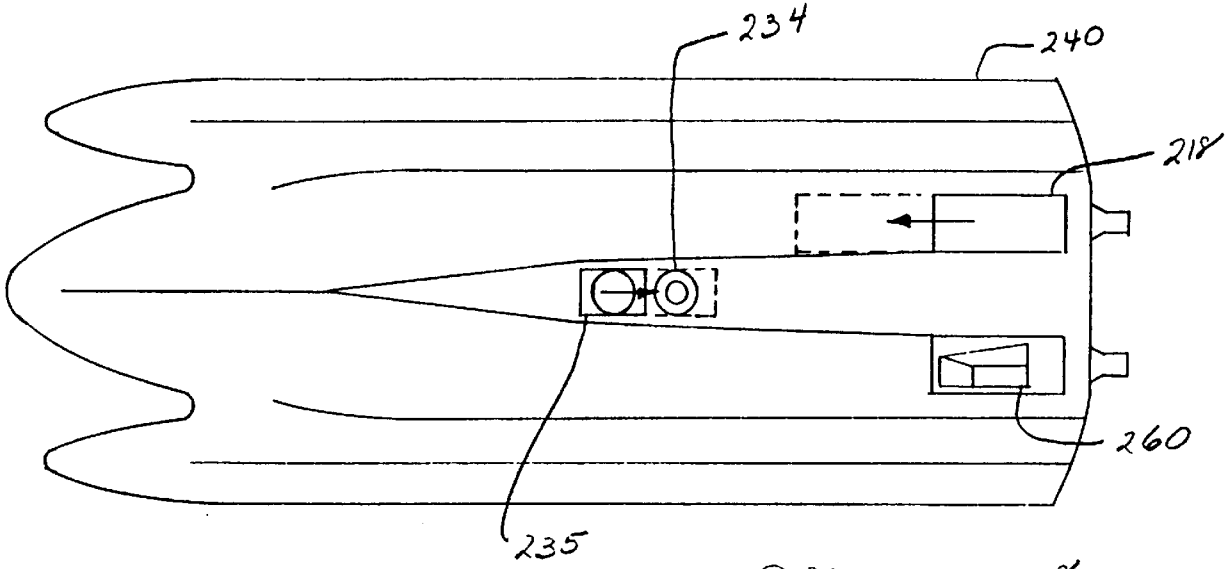
FIG. 23 is a view of the bottom of an exemplary embodiment of a boat hull in accordance with an aspect of the present invention illustrating a configuration of water intake openings for fire fighting purposes.
Figure 24:
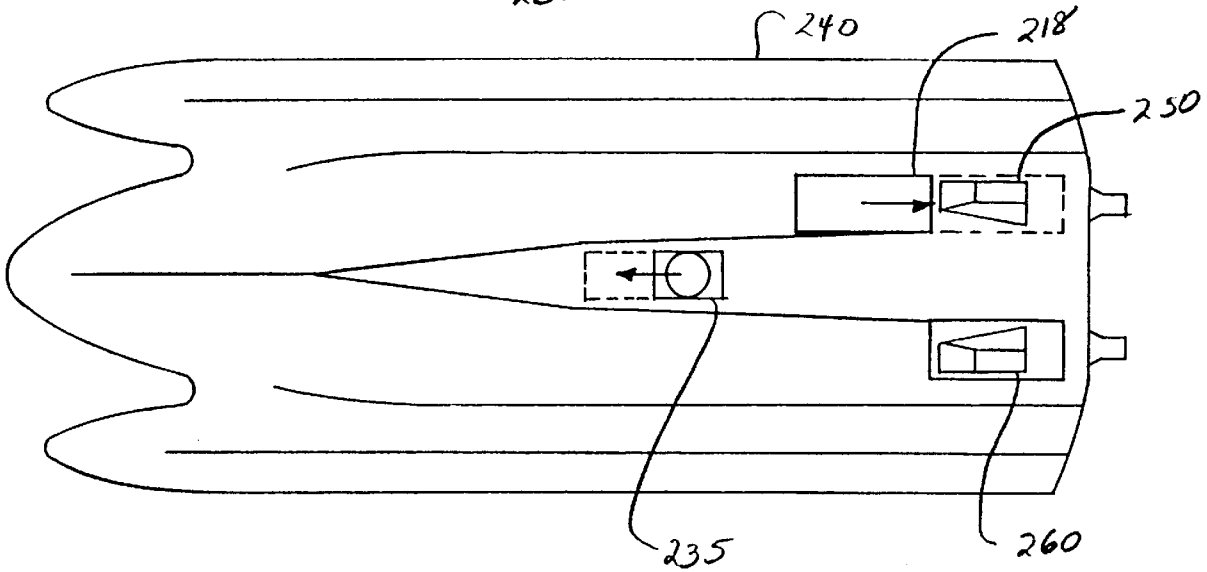
FIG. 24 is a view of the bottom of an exemplary embodiment of a boat hull in accordance with an aspect of the present invention illustrating a configuration of water intake openings for propulsion purposes.

FIGS. 23 and 24 illustrate two of the possible configurations of the cover plates 218, 235. FIG. 23 illustrates how the plates may be positioned when drawing water for use in fire fighting, i.e., propelling water through water monitors mounted on the upper part of the boat. In this configuration, the monitor intake opening 234 is opened by sliding the monitor intake cover 235 away from the monitor intake opening 234. The propulsion opening cover 218 is positioned over the propulsion intake opening 250. The second propulsion intake opening 260 remains open, as the second motor 266 should be available to provide compensating or reactive forces to counteract the forces supplied to the boat by the upper water monitors used for fire fighting. Preferably, the propulsion intake cover 218 may also be positioned in intermediate positions, partially covering the propulsion intake opening 250. This allows the propulsion intake opening 250 to be partially opened, for example, to provide greater water flow in certain instances than may be possible through the monitor intake opening 234 by itself.

FIG. 24 illustrates how the plates might be positioned when in the drive or propulsion configuration, i.e. when the boat is being propelled forward. In this configuration, the monitor intake opening 234 is closed by sliding the monitor intake cover 235 over the monitor intake opening 234. The propulsion intake opening cover 218 is removed from the propulsion intake opening 250, to open the propulsion intake opening 250 so that water may be drawn through that opening. The illustrations of FIG. 23 and FIG. 24 do not show the additional debris cover 212 illustrated in the embodiment of FIG. 12.

Referring again to the configuration illustrated in FIG. 18, the hull 340 may be approximately 12 feet in length, and eight feet in beam. The embodiment illustrated in FIG. 18 is essentially identical to the embodiment illustrated in FIGS. 12–17, except for the length and width of the hull. The embodiment illustrated in FIG. 18 also contains two propulsion motors similar to the propulsion motors 256, 266 of the embodiment illustrated in FIGS. 12 and 13. First and second propulsion water intakes 350, 360 are provided on the bottom of the hull, and outlet jets 352, 362 are provided from the rear of the hull 340. A conduit (not shown) provides passage for water from the first propulsion water intake 350 to the outlet jet 352. A motor similar to the motor 256 (FIGS. 12 and 13) is connected to that conduit for propelling fluid through the conduit and out of the outlet jet 352 at a high rate of speed. Similarly, a conduit (not shown) leads from the second propulsion intake 360 to the outlet jet 362. A second motor similar to the motor 266 of FIGS. 12 and 13 is connected to that conduit for propelling water through the conduit and out of the outlet jet 362 at a high rate of speed. Both motors, directing water out of the outlet jets 352, 362 may provide propulsion for the boat.

In at least one of the conduits connecting one of the intakes 350, 360 with the corresponding one of the outlet jets 352, 362, there is a baffle, and a connection to a monitor conduit similar to be monitor conduit 270 illustrated in FIGS. 15–17.

A separate monitor intake opening 334, similar to the monitor intake openings 134 (FIG. 2) and 234 (FIG. 12) is included through the bottom of the hull 340. Furthermore, a monitor conduit provides fluid communication between the monitor intake opening 334 and the conduit through which the first motor draws water from the first propulsion intake 350.

As noted above, one application for the boat of the present invention is to provide emergency fire and medical services. In conjunction with providing such services, there may be several people on board, both personnel, and, in the case of medical services, injured or sick persons. These people may be moving around the on the boat, and at times may be getting off and back on. In addition, victims to whom medical attention is being provided may be placed upon the deck of the boat. Furthermore, at different times personnel may be placing or removing equipment from the boat. Therefore, it is important for the boat to remain very stable as people move around on the boat, as people get on or are placed on the boat, and as people get off the boat.

In addition, the boat is designed to move at high speed through the water to reach an emergency scene. In one exemplary embodiment, a boat of the type illustrated in FIG. 1 may move at speeds up to 55 mph. At such speeds, with emergency medical personnel on board, the boat must remain stable, and must maintain directional stability so that it is easy for the operator at the operator station 50 to maneuver. In addition, once at the scene, the boat must be easy for the operator positioned at the operator's station 50 to maintain the position and direction of the boat so that the personnel operating the water monitors 70 can accurately aim the stream of water from the monitor nozzle 72.

The jet propelled boat of the present invention includes a novel hull shape. This hull is in the shape of a progressive Hydro V. The hull shape of the invention provides a high degree of stability when the boat 30 is moving at high speed or in rough water, and also provides a stable platform for personnel when the boat is stationary.

As will be recognized by those familiar with the design of boat hulls, a boat hull that is shallow and relatively flat on the bottom is very stable as weight in the hull (such as people and equipment) is moved about. Thus, such shallow hulls have advantages for supporting work platforms for tasks such as emergency medical activities. However, such shallow hulls have poor directional stability. When moving through the water, they tend to drift from the desired path. When stationary (as at the work or task scene), they tend to turn and drift in the water. In contrast, a steep "V" shape for the hull provides a high degree of directional stability. But, a boat with a steep "V" shaped hull tends to tip substantially from side to side as weight is moved about within the hull or on the deck.

In accordance with a particular aspect of the present invention, the shape of the hull is such that there are different segments extending along substantially the length of the hull. These segments are formed in the hull along the rearmost ⅔ to ¾ of the hull's length. In a preferred form, the segments are mirrored on either side of the longitudinal centerline of the hull, so that the hull is symmetrical about the centerline, and each segment has a portion on each side of the hull centerline. Each segment (counting both sides) occupies at least 10 percent of the beam of the hull. By appropriately angling each segment of the hull with respect to horizontal (measuring laterally), an optimum balance between directional stability, and weight stability may be achieved.

Figure 4:
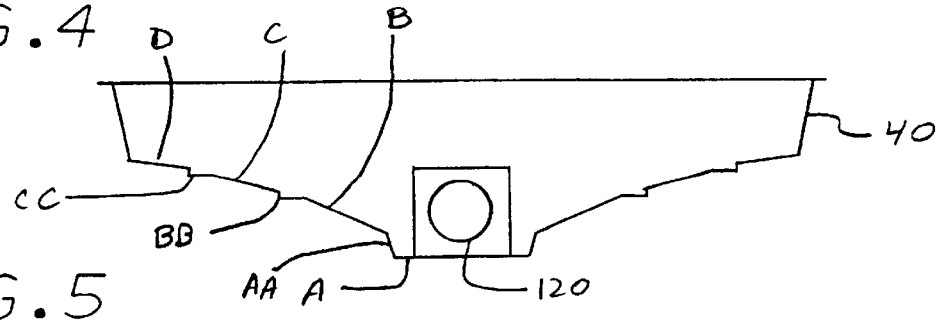
FIG. 4 is a rear elevational view of the hull of the boat shown in FIG. 1, taken along line 4—4 of FIG. 2.

In FIGS. 4–8, cross-sectional views of one embodiment of the hull shape are shown, beginning at the stem in FIG. 4, and moving forward in the hull for each successive figure. Referring to FIG. 4, the stern of the hull 40 is shown, with the propulsion jet opening 120 emerging from the back of the hull.

At each point along the length of the hull, the longitudinal hull segment immediately adjacent the hull centerline is flat or almost flat (horizontal), measured laterally. In other words, it has a shallow angle with respect to horizontal. This segment may be referred to as the center segment, and is identified with the reference A in FIGS. 4–8. In a preferred embodiment, the hull has four longitudinal segments on each side of the hull's centerline. Each of these segments is angled a particular amount. The segment next closest to the center of the hull, and identified with the reference B, has a substantial angle with respect to horizontal. The angles of the other segments are progressively shallower as the segments are farther from the longitudinal centerline of the hull. Thus, the segment D, farthest from the centerline (nearest the side of the hull), has the shallowest angle (although generally not shallower than the substantially flat center segment). The segment nearest the centerline (not including the segment immediately adjacent the centerline) has the steepest angle relative to horizontal.

It is also preferred that each segment as it is farther from the hull centerline occupies a larger percentage of the hull beam (measured horizontally) than the next nearer segment (except that the center segment A may be wider than the next segment). Thus, the segment D closest to be side of the hull is the widest, and the segment B, nearest the centerline of the hull (not including the center segment immediately) is the narrowest.

It is further preferred that near the bow of the hull, the angle of the center segment A and the immediately adjacent segment B increases so that the center portion of the hull has a steeper contour near the bow.

Transitional segments connect the different segments. These transitional segments are shaped to provide rigidity to the overall hull structure. As illustrated, at least some of these transitional segments may be outwardly pointing notches A first transitional segment AA is between the segments A and B. A second transitional segment BB connects the second and third segments. A third transitional segment CC connects the third and fourth segments.

The preferred angle of each longitudinal segment, and its preferred width (measured horizontally, as a percentage of the beam) is provided below for each of the cross-sectional views of FIGS. 4–8. The percentage of beam provided in the tables below is obtained by combining the mirrored segments on both sides of the hull centerline.

FIG. 4:

| Segment | Angle Range (degrees off horizontal) | Preferred Angle (degrees) | Beam Range (% of Beam) | Preferred % of Beam |
|---|---|---|---|---|
| A | 0–10 | 0 | 12–18 | 15 |
| B | 0–35 | 24 | 10–18 | 13 |
| C | 5–30 | 12 | 12–20 | 16 |
| D | −5–20 | 11–12 | 25–35 | 29 |

FIG. 5:

| Segment | Angle Range (degrees off horizontal) | Preferred Angle (degrees) | Beam Range (% of Beam) | Preferred % of Beam |
|---|---|---|---|---|
| A | 0–10 | 5 | 12–18 | 15 |
| B | 0–35 | 25.5 | 10–18 | 13 |
| C | 5–30 | 11–9 | 12–20 | 16 |
| D | 0–20 | 10 | 25–35 | 29 |

FIG. 6:

| Segment | Angle Range (degrees off horizontal) | Preferred Angle (degrees) | Beam Range (% of Beam) | Preferred % of Beam |
|---|---|---|---|---|
| A | 0–12 | 7 | 12–18 | 15 |
| B | 0–35 | 14 | 10–18 | 13 |
| C | 5–30 | 18 | 12–20 | 16 |
| D | 0–20 | 9 | 25–35 | 29 |

FIG. 7:

| Segment | Angle Range (degrees off horizontal) | Preferred Angle (degrees) | Beam Range (% of Beam) | Preferred % of Beam |
|---|---|---|---|---|
| A | 0–20 | 10 | 12–18 | 15 |
| B | 0–40 | 32 | 10–18 | 13 |
| C | 5–30 | 9.5 | 12–20 | 16 |
| D | −10–15 | −2.5 | 25–35 | 29 |

FIG. 8:

| Segment | Angle Range (degrees off horizontal) | Preferred Angle (degrees) | Beam Range (% of Beam) | Preferred % of Beam |
|---|---|---|---|---|
| A | 0–45 | 37 | 12–18 | 15 |
| B | 0–48 | 38 | 10–18 | 13 |

-continued

FIG. 8:

| Segment | Angle Range (degrees off horizontal) | Preferred Angle (degrees) | Beam Range (% of Beam) | Preferred % of Beam |
|---|---|---|---|---|
| C | −5–10 | 1 | 12–20 | 16 |
| D | −5–10 | −6 | 25–35 | 29 |

At the forward end of the hull, there may be no substantially flat horizontal center segment. The hull may have a primary bow 42 and two secondary bows 44, 46 on either side of the primary bow 42. Each of these bows 42, 44, 46 may be substantially "V" shaped. For example, the primary bow 42 may have an angle of 20–50 degrees with respect to horizontal. In one particular embodiment, the bow has an angle of 36 degrees. The center (primary) bow 42 may constitute 50–60 percent of the total beam of the hull 40. In the particular embodiment illustrated in FIG. 1, the primary bow constitutes 55 percent of the beam of the hull 40. However, unlike the more rearward portions of the hull, the hull may be curved to provide a smooth front to the hull.

The shape of the hull for the dual propulsion drive configuration shown in the embodiment of FIGS. 12 and 13, and in the embodiment of FIG. 18, is substantially similar to that shown in FIGS. 4–8, except that the center longitudinal segment corresponding to the segment A shown in FIGS. 4–8 may have a steeper angle than that of the embodiment illustrated in FIGS. 4–8. However, the center segment preferably still has a shallower slope than the adjacent segment. Similarly, the dual drive embodiment illustrated in FIG. 18 may also have a steeper center segment. If cross-sectional views were taken of the hull shown in FIG. 18 at points corresponding to the cross-sectional views shown in FIG. 4–8, the hull segment angles would be as shown in the following tables.

Equivalent to FIG. 4:

| Segment | Angle Range (degrees off horizontal) | Preferred Angle (degrees) | Beam Range (% of Beam) | Preferred % of Beam |
|---|---|---|---|---|
| A | 0–25 | 21 | 12–18 | 15 |
| B | 0–35 | 24 | 10–18 | 13 |
| C | 5–30 | 15 | 12–20 | 16 |
| D | 0–20 | 5 | 25–35 | 29 |

Figure 5:
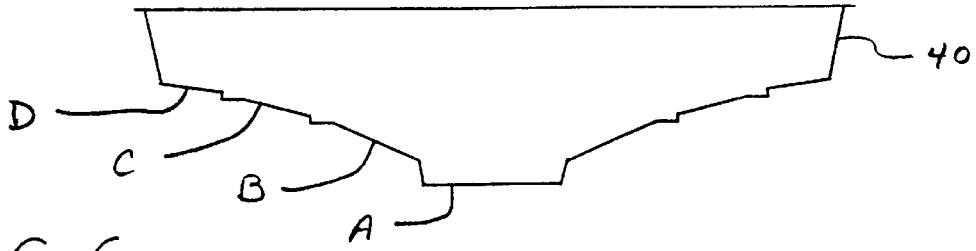
FIGS. 5,6,7, and 8 are cross-sectional views of one embodiment of the hull, taken along the line 5—5,6—6,7—7, and 8—8, respectively, of FIG. 2.

Equivalent to FIG. 5:

| Segment | Angle Range (degrees off horizontal) | Preferred Angle (degrees) | Beam Range (% of Beam) | Preferred % of Beam |
|---|---|---|---|---|
| A | 0–25 | 21 | 12–18 | 15 |
| B | 0–35 | 24 | 10–18 | 13 |
| C | 5–30 | 15 | 12–20 | 16 |
| D | 0–20 | 5 | 25–35 | 29 |

Figure 6:
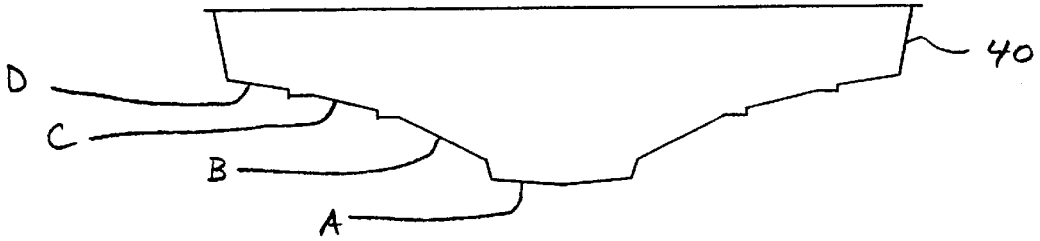

Equivalent to FIG. 6:

| Segment | Angle Range (degrees off horizontal) | Preferred Angle (degrees) | Beam Range (% of Beam) | Preferred % of Beam |
|---|---|---|---|---|
| A | 0–25 | 21 | 12–18 | 15 |
| B | 0–35 | 28 | 10–18 | 13 |
| C | 5–30 | 15 | 12–20 | 16 |
| D | 0–20 | 5 | 25–35 | 29 |

Figure 7:
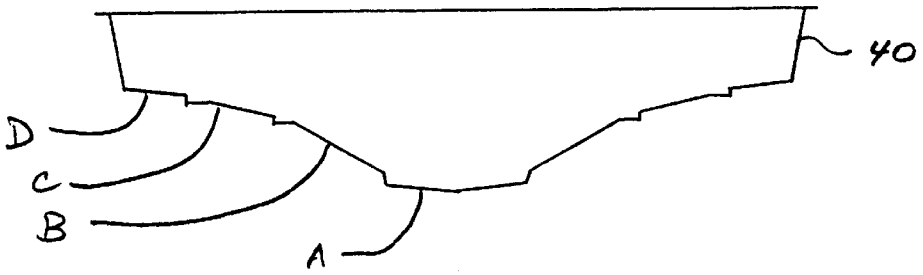

Equivalent to FIG. 7:

| Segment | Angle Range (degrees off horizontal) | Preferred Angle (degrees) | Beam Range (% of Beam) | Preferred % of Beam |
|---|---|---|---|---|
| A | 0–25 | 21 | 12–18 | 15 |
| B | 0–35 | 30 | 10–18 | 13 |
| C | 5–30 | 13.5 | 12–20 | 16 |
| D | 0–20 | 5 | 25–35 | 29 |

Figure 8:
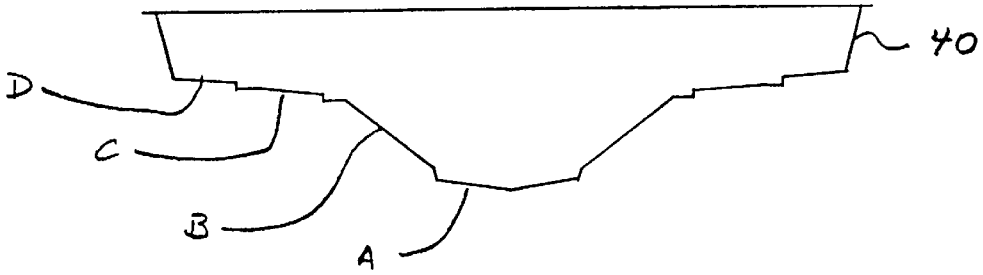
Figure 9:
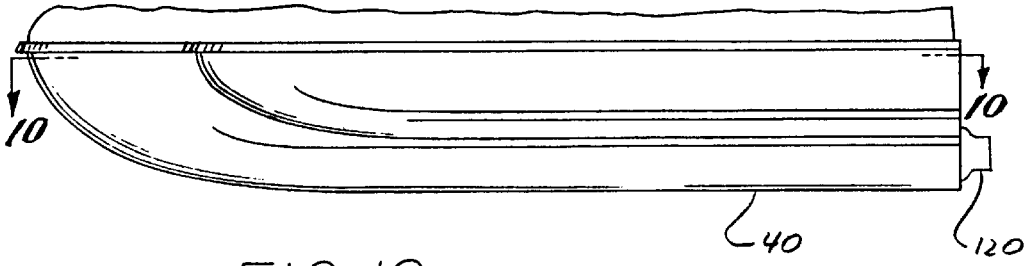
FIG. 9 is a side elevational view of the hull of the boat shown in FIG. 1.

Equivalent to FIG. 8:

| Segment | Angle Range (degrees off horizontal) | Preferred Angle (degrees) | Beam Range (% of Beam) | Preferred % of Beam |
|---|---|---|---|---|
| A | 0–25 | 21 | 12–18 | 15 |
| B | 0–35 | 32 | 10–18 | 13 |
| C | 5–30 | 3.5 | 12–20 | 16 |
| D | 0–20 | 4 | 25–35 | 29 |

In certain implementations of the progressive "V" shaped hull, the segment identified as "A" above may be omitted from the hull shape. Omission of the segment A may have certain benefits with respect to the operation of the two drive motor embodiments (FIG. 12 and FIG. 18) intended for operation in open water, such as on the open ocean.

Those skilled in the art will recognize that various modifications can be made to the preferred embodiments described above without departing from the concepts of the invention as defined in the following claims. For example, modifications to the exact positions of the motors, the water intakes, the shapes of the water intakes, the shapes and positions of the water intake covers, and some of the specific parameters of the hull shape may all be made without departing from the spirit of the invention.

I claim:

1. In a jet powered boat comprising a hull, a fluid jet conduit having an intake along the bottom of the hull, and a jet outlet at the rear of the hull, a drive motor for propelling water from the intake trough the conduit to jet outlet, and an operator control station within the hull, wherein the operator control station contains controls for the drive motor and the jet outlet, the improvement comprising:

an outlet water monitor mounted on the top of the hull, wherein the water monitor is movable to direct a stream of water in one of a plurality of directions;

a hull opening through the bottom of the hull;

a water conduit connecting the hull opening to the outlet monitor; and a pump engine connected to the conduit for drawing water substantially vertically through the hull opening and the conduit to the outlet monitor.

2. The improved jet powered boat of claim 1, wherein the hull opening is nearer to the longitudinal centerline of the hull than it is to the side of the hull.

3. The improved jet powered boat of claim 2, wherein the hull opening is on the longitudinal centerline of the hull.

4. The improved jet powered boat of claim 3, wherein the pump engine is mounted inside the hull on the longitudinal centerline of the hull.

5. The improved jet powered boat of claim 1, additionally comprising a second outlet water monitor mounted on the top of the hull, wherein the second water outlet monitor is movable to direct a second stream of water in any of a plurality of directions, wherein:

the water conduit connects the hull opening to the first water outlet monitor and to the second water outlet monitor; and the pump engine draws water through the water conduit from the hull opening to the first outlet monitor and to the second outlet monitor.

6. The improved jet powered boat of claim 5, wherein the first and second water outlet monitors are mounted on the forward portion of the hull.

7. The improved jet powered boat of claim 1, additionally comprising a secondary conduit connecting the pump engine with the jet outlet at the rear of the hull.

8. The improved jet powered boat of claim 7, additionally comprising valving to selectively control whether the pump engine directs water through the water conduit to the outlet monitor, or through the secondary conduit to the jet outlet.

9. A jet powered boat comprising:

a hull;

a propulsion water conduit having a propulsion intake through the bottom of the hull and a propulsion outlet at the rear of the hull;

a first motor connected to the propulsion water conduit for directing water through the propulsion conduit from the propulsion intake to the propulsion outlet;

a water monitor attached to the upper side of the hull;

a substantially vertical monitor intake opening through the bottom of the hull;

a monitor water conduit connecting the monitor intake to the water monitor; and a second motor connected to the monitor water conduit for directing water through the monitor water conduit from the monitor intake opening to the water monitor.

10. The jet powered boat of claim 9, wherein the monitor intake opening is closer to the longitudinal centerline of the hull than it is to the sides of the hull.

11. The jet powered boat of claim 10, wherein the monitor intake opening is along the longitudinal centerline of the hull.

12. The jet powered boat of claim 11, additionally comprising:

a second propulsion water conduit intersecting the monitor water conduit at a point between the second motor and the water monitor, wherein the second propulsion water conduit has a second propulsion outlet at the rear of the hull;

a movable baffle in the monitor water conduit at the point at which the monitor water conduit and the second propulsion water conduit intersect, wherein:

the baffle is movable between a monitor position and a propulsion position;

when the baffle is in the monitor position, the baffle directs water through the monitor conduit, but substantially restricts the flow of water through the second propulsion conduit; and when the baffle is in the propulsion position, the baffle directs water from the monitor water conduit into the second propulsion conduit.

13. The jet powered boat of claim 12, additionally comprising:

a second propulsion intake through the bottom of the hull, wherein the second propulsion intake is connected to the monitor water conduit; and a flow controller to selectively control whether water enters the monitor water conduit through the monitor intake opening or through the second propulsion intake.

14. The jet boat of claim 12, additionally comprising a control connection between operator position and the baffle for moving to baffle between the first position and the second position.

15. The jet boat of claim 14, wherein the control connection comprises a cable connected to the baffle.

16. The jet boat of claim 14, wherein the first and second motors are mounted in the hull on opposite sides of the centerline of the hull.

17. The jet powered boat of claim 9, wherein:

the monitor intake opening is on one side of the longitudinal centerline of the hull, closer to the longitudinal centerline than to the side of the hull;

the propulsion intake is on the opposite side of the longitudinal centerline of the hull, closer to the longitudinal centerline than to the side of the hull.

18. In a boat comprising a hull, a drive motor for propelling the hull through water, and an operator station within the hull, wherein the operator control station contains controls for the drive motor, the improvement comprising:

an outlet water monitor mounted on the of the hull, wherein the water monitor is movable to direct a stream of water in one of a plurality of directions;

a hull opening through the bottom of the hull;

a water conduit connecting the hull opening to the outlet monitor; and a pump engine mounted in the hull and connected to the conduit for drawing water substantially vertically through the hull opening and into the conduit to the outlet monitor.

* * * * *